US012031756B2

(12) United States Patent
Kaneko et al.

(10) Patent No.: US 12,031,756 B2
(45) Date of Patent: Jul. 9, 2024

(54) HEAT EXCHANGER PASSAGE SWITCHING DEVICE

(71) Applicant: MITSUBISHI HEAVY INDUSTRIES, LTD., Tokyo (JP)

(72) Inventors: Yasuaki Kaneko, Tokyo (JP); Nobuhide Hara, Tokyo (JP); Hiroyuki Nakaharai, Tokyo (JP); Yoichi Uefuji, Tokyo (JP); Masaya Hatanaka, Tokyo (JP); Koichi Tanimoto, Tokyo (JP); Toshiyuki Ishida, Tokyo (JP); Takuo Oda, Tokyo (JP); Shunsaku Eguchi, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 163 days.

(21) Appl. No.: 17/800,809

(22) PCT Filed: Feb. 24, 2021

(86) PCT No.: PCT/JP2021/006777
§ 371 (c)(1),
(2) Date: Aug. 18, 2022

(87) PCT Pub. No.: WO2021/172324
PCT Pub. Date: Sep. 2, 2021

(65) Prior Publication Data

US 2023/0080711 A1 Mar. 16, 2023

(30) Foreign Application Priority Data

Feb. 27, 2020 (JP) ..... 2020-031414

(51) Int. Cl.
*F25B 41/26* (2021.01)
*F28F 3/08* (2006.01)
*F28F 27/02* (2006.01)

(52) U.S. Cl.
CPC ..... *F25B 41/26* (2021.01); *F28F 3/08* (2013.01); *F28F 27/02* (2013.01)

(58) Field of Classification Search
CPC ..... F25B 41/26; F28F 3/08; F28F 27/02
See application file for complete search history.

(56) References Cited

U.S. PATENT DOCUMENTS 4,924,938 A 5/1990 Plaschkes
5,634,352 A 6/1997 Nagai et al.
(Continued)

FOREIGN PATENT DOCUMENTS

EP 3 611 443 B1 11/2020
JP 58-28066 A 2/1983
(Continued)

OTHER PUBLICATIONS

International Preliminary Report on Patentability and Written Opinion of the International Searching Authority for International Application No. PCT/JP2021/006777, dated Sep. 9, 2022, with an English translation.

(Continued)

*Primary Examiner* — P. Macade Nichols
(74) *Attorney, Agent, or Firm* — Birch, Stewart, Kolasch & Birch, LLP

(57) ABSTRACT

A heat exchanger passage switching device according to an embodiment includes: a communication tube having an internal passage communicating with a heat exchange passage for performing heat exchange inside a heat exchanger, and one or more communication holes communicating with the internal passage; and at least one chamber having an insertion hole into which the communication tube is inserted to slidably support the communication tube inserted in the insertion hole. The communication tube is capable of switching a communication state between the one or more (Continued)

communication holes and the at least one chamber by a relative position of the communication tube to the at least one chamber in an axial direction.

9 Claims, 27 Drawing Sheets

(56) References Cited

U.S. PATENT DOCUMENTS

| | | | | |
|---|---|---|---|---|
| 2008/0023182 | A1* | 1/2008 | Beamer | F28D 1/05391 165/137 |
| 2011/0088427 | A1* | 4/2011 | Ishii | F16K 31/1225 62/529 |
| 2014/0374081 | A1 | 12/2014 | Kakehashi et al. | |
| 2015/0000327 | A1 | 1/2015 | Kakehashi et al. | |
| 2022/0290924 | A1 | 9/2022 | Eguchi et al. | |

FOREIGN PATENT DOCUMENTS

| | | | |
|---|---|---|---|
| JP | 64-28490 | A | 1/1989 |
| JP | 7-32484 | A | 12/1995 |
| JP | 3406896 | B2 | 5/2003 |
| JP | 2006-242395 | A | 9/2006 |
| JP | 2013-231574 | A | 11/2013 |
| JP | 2017-190946 | A | 10/2017 |
| JP | 2021-38894 | A | 3/2021 |
| WO | WO 2018/189805 | A1 | 10/2018 |

OTHER PUBLICATIONS

International Search Report and Written Opinion of the International Searching Authority for International Application No. PCT/JP2021/006777, dated Apr. 6, 2021.

* cited by examiner

HEAT EXCHANGER PASSAGE SWITCHING DEVICE

TECHNICAL FIELD

The present disclosure relates to a heat exchanger passage switching device.

BACKGROUND

Heat exchangers are used in various devices, plants, etc., for the purpose of heating or cooling fluids. There are various types of heat exchangers; for example, a heat exchanger in which a heat exchanger core composed of a laminate of plates is housed inside a cylindrical casing is known (Patent Document 1).

CITATION LIST

Patent Literature

Patent Document 1: JP3406896B

SUMMARY

Problems to be Solved

However, when a heat exchanger core is formed by stacking plates as in Patent Document 1, the shape of the heat exchanger core is inevitably restricted. In response to this, in recent years, a heat exchanger core of a heat exchanger has been manufactured by additive manufacturing using a 3D printer, with markedly improved performance. By producing the heat exchanger core by additive manufacturing, it is possible to significantly reduce the constraints on the shape of the heat exchanger core.

However, for example, due to constraints on the size of the additive manufacturing device, many of the products obtained by additive manufacturing are relatively small products. Therefore, in order to exchange heat of a relatively large amount of fluid using the heat exchanger core produced by additive manufacturing, it is conceivable to connect multiple heat exchanger cores to secure a heat exchangeable flow rate.

In order to connect multiple heat exchanges cores, it is generally conceivable to connect heat exchanger cores by piping or the like.

However, when changing the number of heat exchanger cores to be connected or when switching the flow of fluid through the heat exchanger cores between parallel and counter flow, it is often necessary to temporarily stop the use of the heat exchanger to change the connection passage by piping.

In view of the above, an object of at least one embodiment of the present disclosure is to provide a heat exchanger passage switching device that can easily change the distribution passage of fluid flowing through the heat exchanger.

Solution to the Problems (1) A heat exchanger passage switching device according to at least one embodiment of the present disclosure includes: a communication tube having an internal passage communicating with a heat exchange passage for performing heat exchange inside a heat exchanger, and one or more communication holes communicating with the internal passage; and at least one chamber having an insertion hole into which the communication tube is inserted to slidably support the communication tube inserted in the insertion hole. The communication tube is capable of switching a communication state between the one or more communication holes and the at least one chamber by a relative position of the communication tube to the at least one chamber in an axial direction.

Advantageous Effects

According to at least one embodiment of the present disclosure, it is possible to easily change the distribution passage of fluid flowing through the heat exchanger by the heat exchanger passage switching device.

DETAILED DESCRIPTION

Embodiments of the present disclosure will be described below with reference to the accompanying drawings. It is intended, however, that unless particularly identified, dimensions, materials, shapes, relative positions, and the like of components described in the embodiments shall be interpreted as illustrative only and not intended to limit the scope of the present disclosure.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

(Heat Exchanger Subject to Passage Switching)

First, an overview of a heat exchanger subject to passage switching by a heat exchanger passage switching device according to some embodiments will be described.

Figure 1:
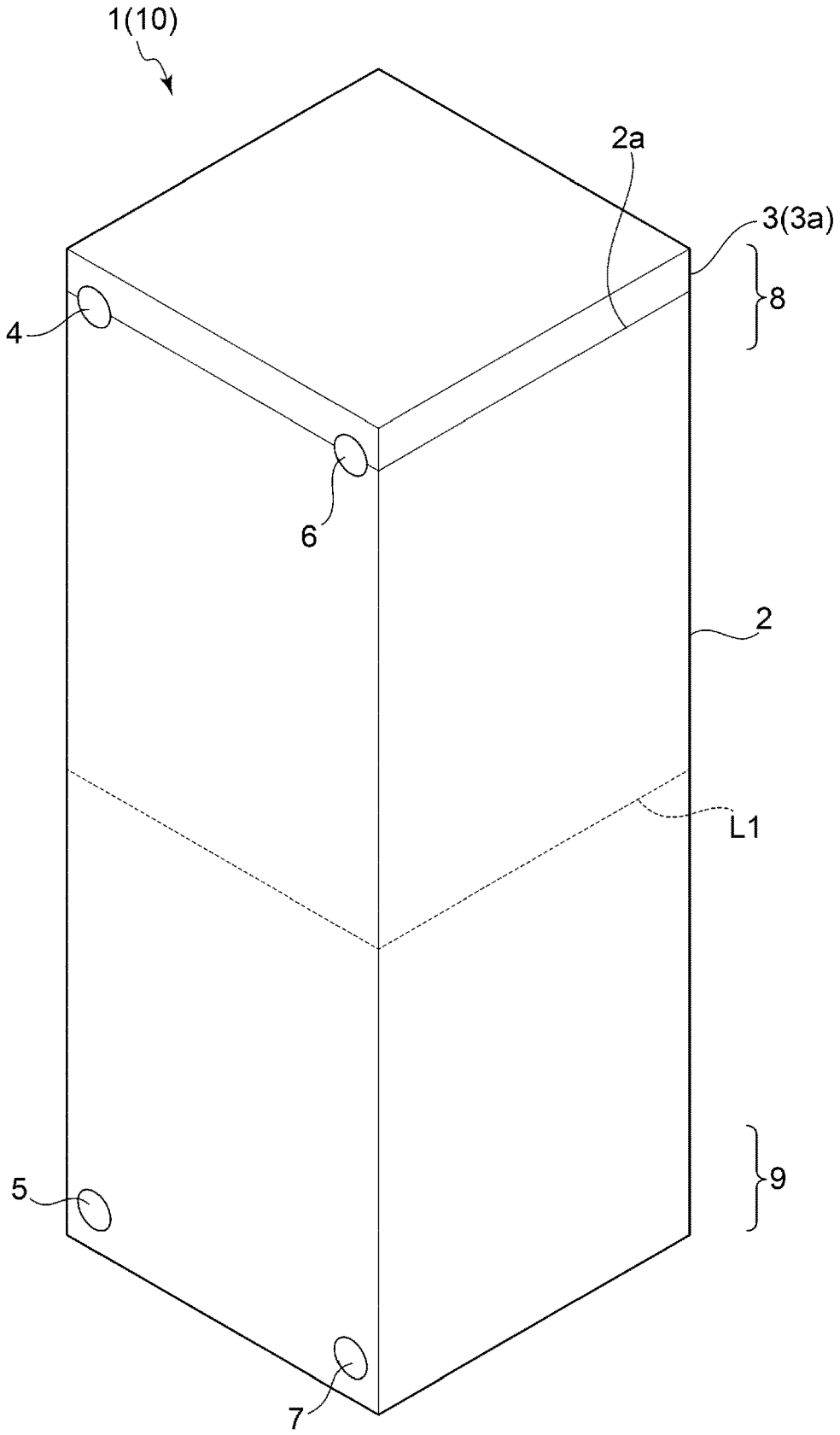
FIG. 1 is a schematic perspective view of a heat exchanger core of a heat exchanger according to at least one embodiment of the present disclosure.

FIG. 1 is a schematic perspective view of a heat exchanger core 1 of a heat exchanger according to an embodiment. The heat exchanger core 1 shown in FIG. 1 is a heat exchanger core 1 used in a heat exchanger 10 for exchanging heat between a first fluid and a second fluid, and includes a body part 2 and a covering part 3 attached to the body part 2. The first fluid and the second fluid may each be a liquid or a gas, but the temperatures of both are usually different. Although not limited, the body part 2 can have a rectangular cuboid shape. In the case where the body part 2 has a rectangular cuboid shape, a rectangular lid member 3*a*, which is the covering part 3, is attached to one end 2*a* of the body part 2 in the longitudinal direction. The covering part 3 may be detachably attached to the body part 2 by fastening with bolts or the like, or may be irreversibly attached by welding or with adhesive or the like.

The heat exchanger core 1 shown in FIG. 1 may be used, for example, while being attached to a housing (not shown) of the heat exchanger 10. Alternatively, the heat exchanger core 1 shown in FIG. 1 may be used while being installed on a mount or supported by a tube (not shown) connected to the heat exchanger core 1, without being attached to the housing. In this case, the heat exchanger core 1 shown in FIG. 1 itself serves as the heat exchanger 10.

Figure 2:
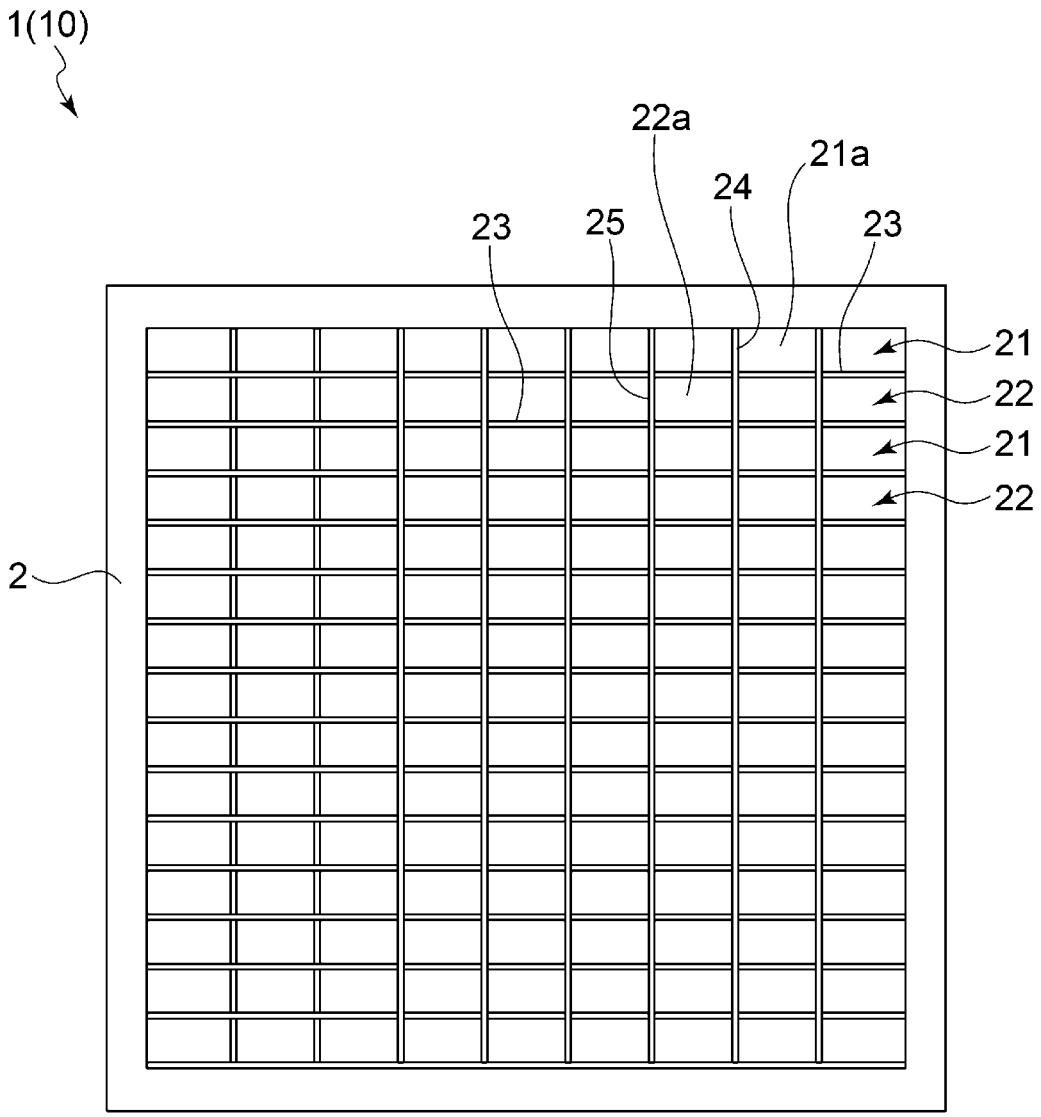
FIG. 2 is an end view of a section cut along the dotted line L1 of FIG. 1.

FIG. 2 is an end view of a section cut along the dotted line L1 of FIG. 1.

As shown in FIG. 2, the body part 2 according to an embodiment has first passages 21 through which the first fluid mainly flows and second passages 22 through which the second fluid mainly flows as heat exchange passages for heat exchange inside the heat exchanger 10 (heat exchanger core 1). The first passages 21 and the second passages 22 are each formed so as to extend along the longitudinal direction of the body part 2 (the direction perpendicular to the paper in FIG. 2). The first passages 21 and the second passages 22 are alternately arranged in the direction perpendicular to the longitudinal direction of the body part 2. The first passage 21 and the second passage 22 that are adjacent to each other are separated by a partition wall 23. The numbers of first passages 21 and second passages 22, that is, the number of partition walls 23 is not limited to the number shown in FIG. 2, and can be designed to any number.

Each first passage 21 and each second passage 22 may be divided into a plurality of divided passages 21*a* and a plurality of divided passages 22*a* by a plurality of dividing walls 24, 25, respectively. In this case, the numbers of divided passages 21*a* and 22*a*, that is, the number of dividing walls 25 is not limited to the number shown in FIG. 2, and can be designed to any number.

As shown in FIG. 1, the heat exchanger core 1 according to an embodiment includes a first fluid first header passage 4, a first fluid second header passage 5, a second fluid first header passage 6, and a second fluid second header passage 7.

The first fluid first header passage 4 communicates with an end portion of each first passage 21 on the upper side in FIG. 1. The first fluid second header passage 5 communicates with an end portion of each first passage 21 on the lower side in FIG. 1.

The second fluid first header passage 6 communicates with an end portion of each second passage 22 on the upper side in FIG. 1. The second fluid second header passage 7 communicates with an end portion of each second passage 22 on the lower side in FIG. 1.

In the example shown in FIG. 1, the headers 8, 9 are provided on one end side and the other end side in the longitudinal direction of the body part 2. For convenient of explanation, the header 8 on the upper side in FIG. 1 is referred to as a first header 8, and the header 9 on the lower side in FIG. 1 is referred to as a second header 9.

In the heat exchanger core 1 according to an embodiment shown in FIG. 1, a fluid supplied to one of the first fluid first header passage 4 or the first fluid second header passage 5 flows through each first passage 21 and then is discharged from the other of the first fluid first header passage 4 or the first fluid second header passage 5.

Similarly, in the heat exchanger core 1 according to an embodiment shown in FIG. 1, a fluid supplied to one of the second fluid first header passage 6 or the second fluid second header passage 7 flows through each second passage 22 and then is discharged from the other of the second fluid first header passage 6 or the second fluid second header passage 7.

In the heat exchanger core 1 according to an embodiment shown in FIG. 1, the fluid flowing through the first passage 21 and the fluid flowing through the second passage 22 exchange heat via the partition wall 23.

The body part 2 of the heat exchanger core 1 according to an embodiment shown in FIG. 1 is difficult to manufacture by laminating plates or casting due to the complexity of the structure. Therefore, it is preferable that the body part 2 is produced by additive manufacturing using metal powder as a raw material. In this case, the body part 2 is an additive manufactured body of metal powder. The metal powder used for additive manufacturing the body part 2 is not particularly limited, but powder of stainless steel or titanium may be used. On the other hand, since the structure of the lid member 3*a* is not as complicated as the body part 2, the lid member 3*a* may be produced by casting or the like, or may be produced by additive manufacturing with metal powder in the same way as the body part 2.

In the following, as an example of a heat exchanger subject to passage switching by a heat exchanger passage switching device 50 according to some embodiments, the heat exchanger core 1 (heat exchanger 10) according to the above-described embodiment will be described. However, the heat exchanger subject to passage switching by the heat exchanger passage switching device 50 according to some embodiments is not limited to the heat exchanger core 1 (heat exchanger 10) according to the above-described embodiment, but may be a plate heat exchanger, for example.

(Overall Configuration of Heat Exchanger Passage Switching Device)

Figure 3:
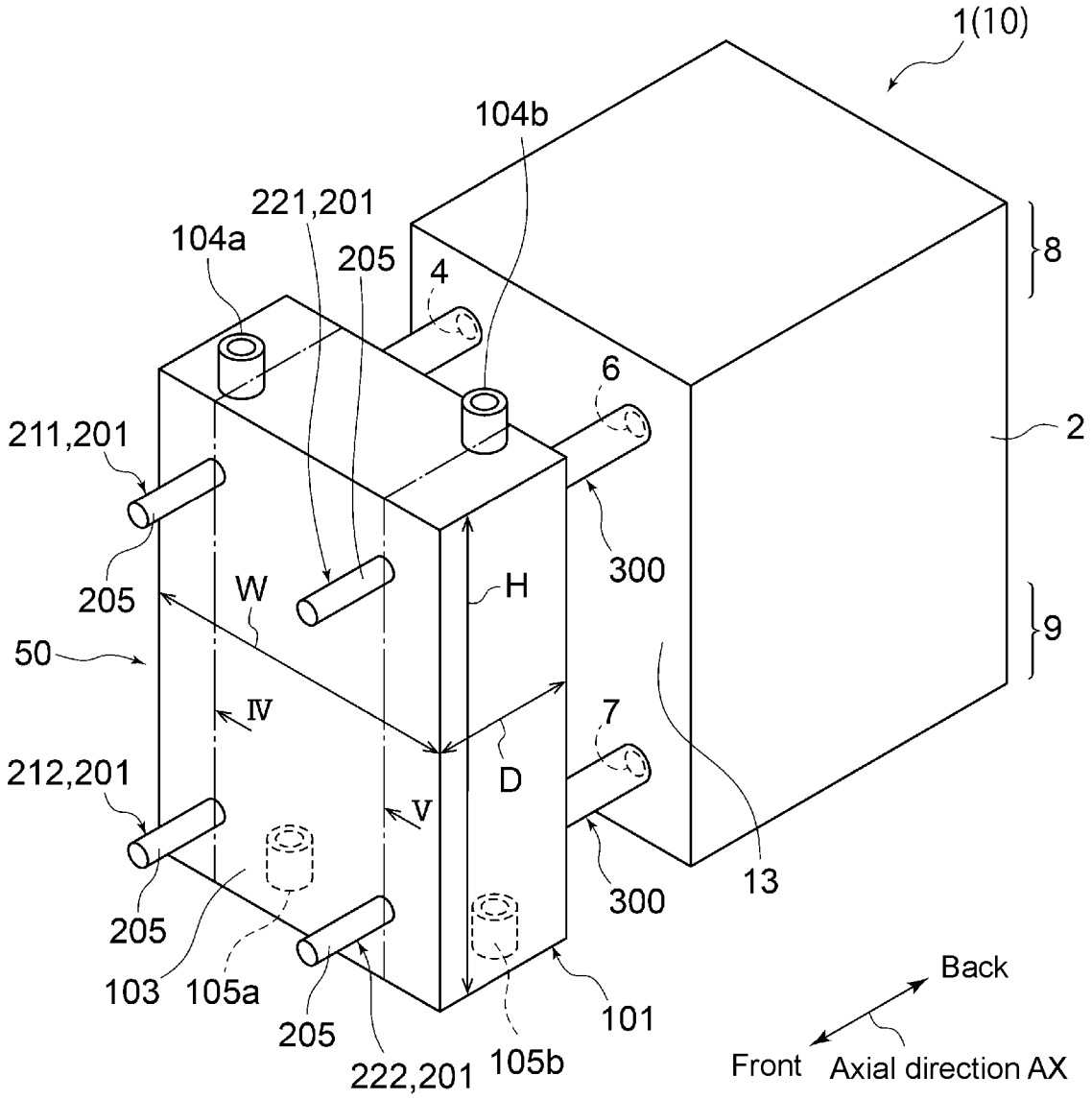
FIG. 3 is a perspective view of a schematic appearance of a heat exchanger passage switching device according to some embodiments.

FIG. 3 is a perspective view of a schematic appearance of the heat exchanger passage switching device 50 according to some embodiments.

Figure 4:
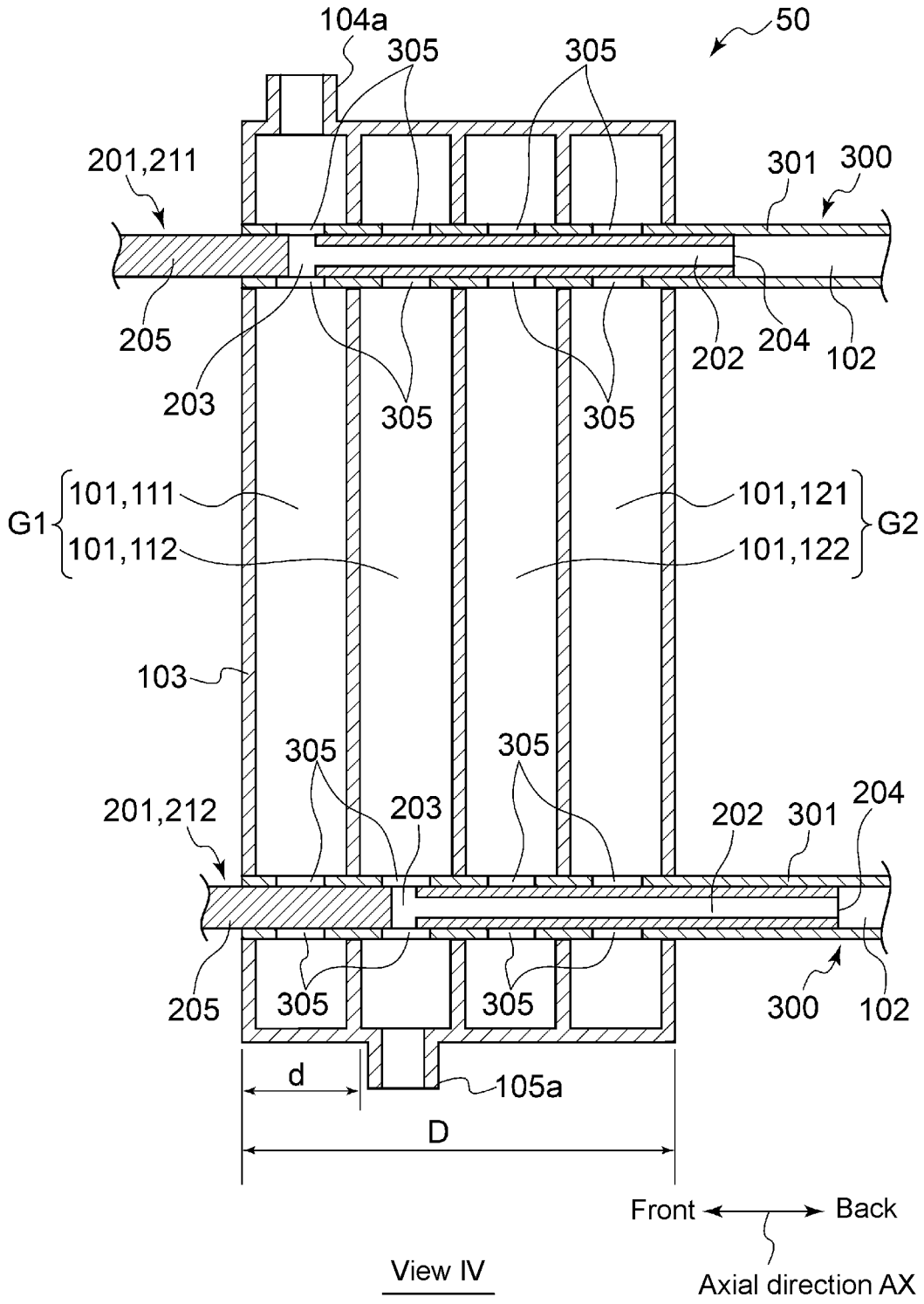
FIG. 4 is a cross-sectional view IV of FIG. 3.

FIG. 4 is a cross-sectional view IV of FIG. 3 and schematically shows the internal structure of the heat exchanger passage switching device 50.

Figure 5:
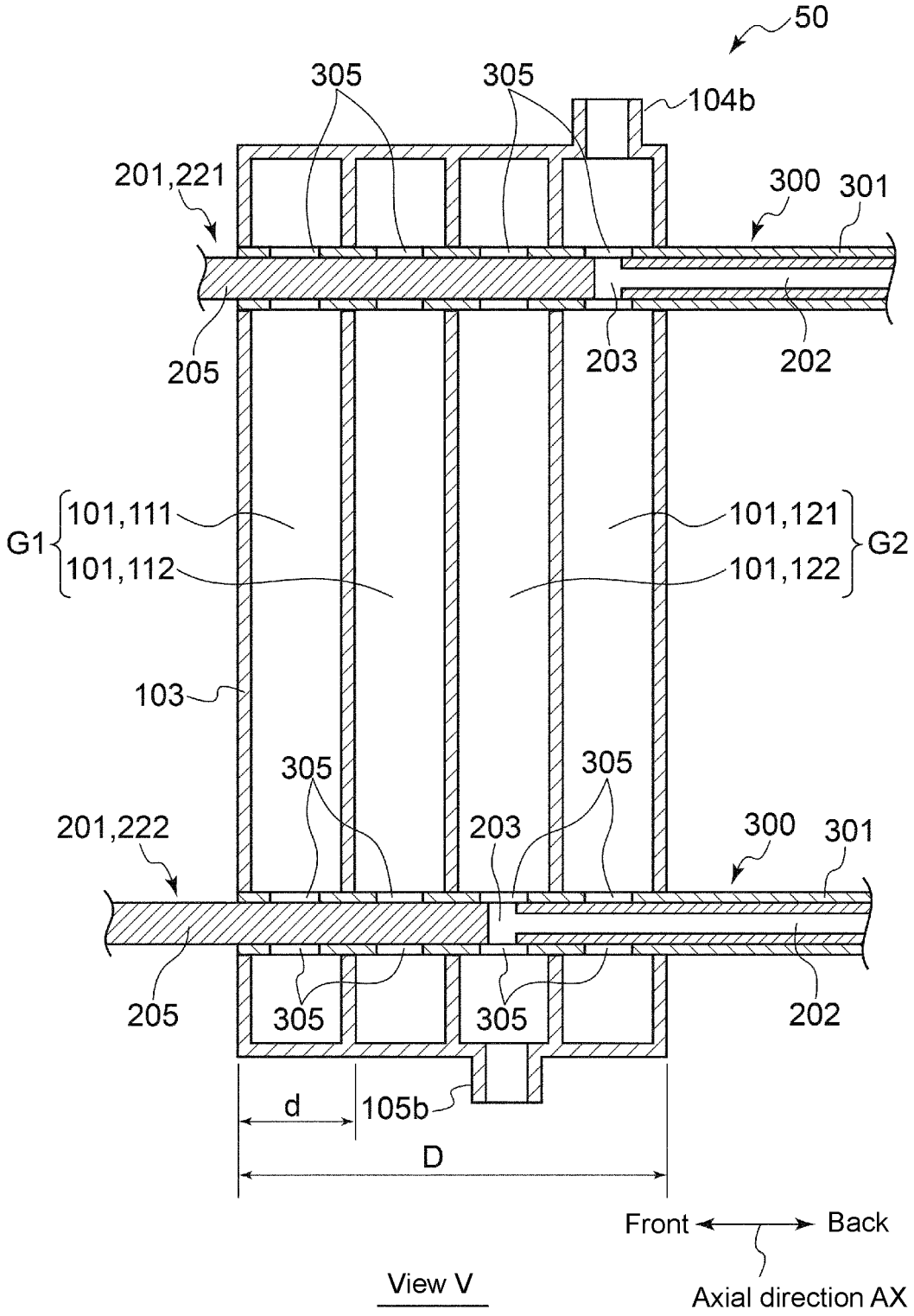
FIG. 5 is a cross-sectional view V of FIG. 3.

FIG. 5 is a cross-sectional view V of FIG. 3 and schematically shows the internal structure of the heat exchanger passage switching device 50.

Figure 6A:
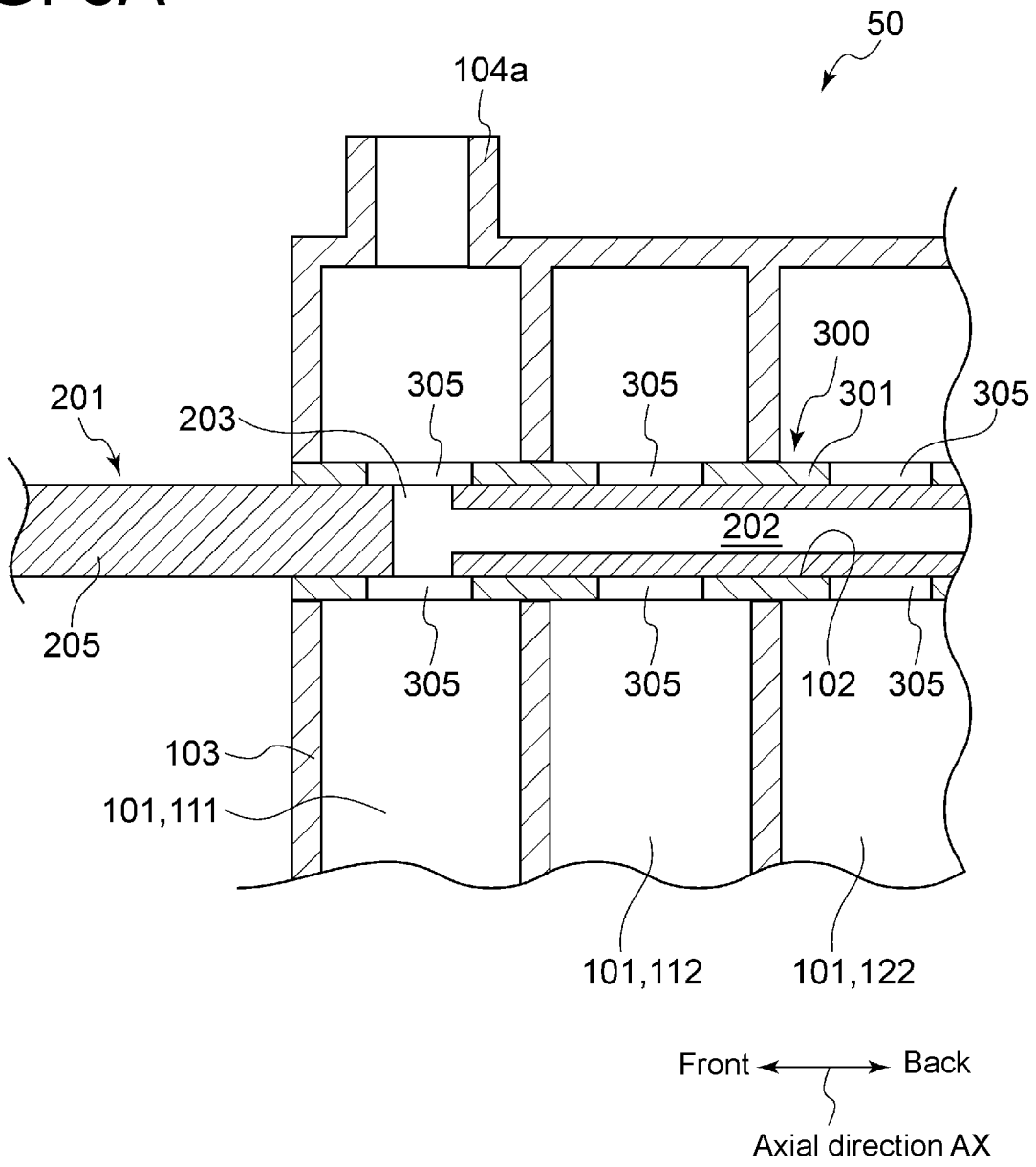
FIG. 6A is a partial enlarged view of FIG. 4.
Figure 6B:
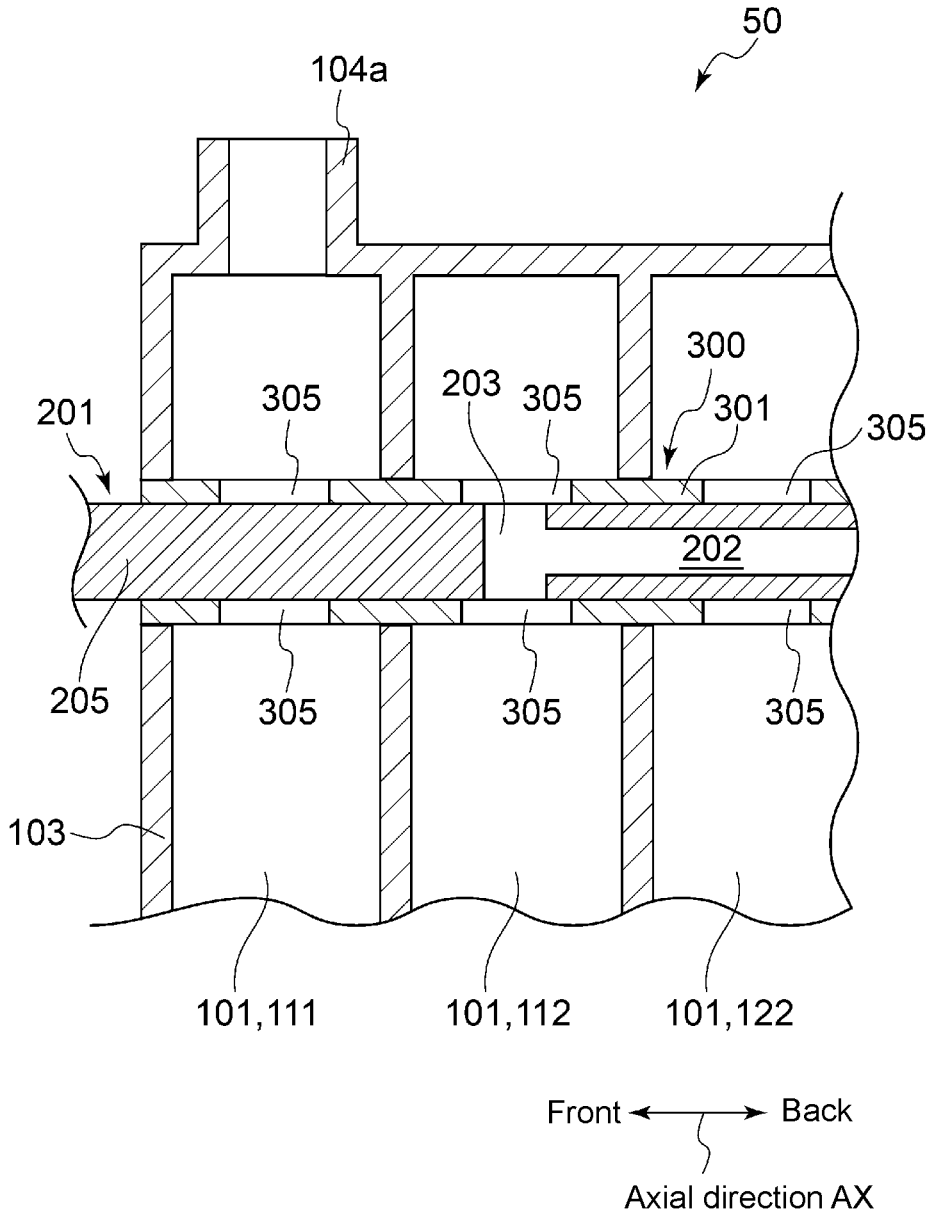
FIG. 6B is a partial enlarged view of FIG. 4.
Figure 6C:
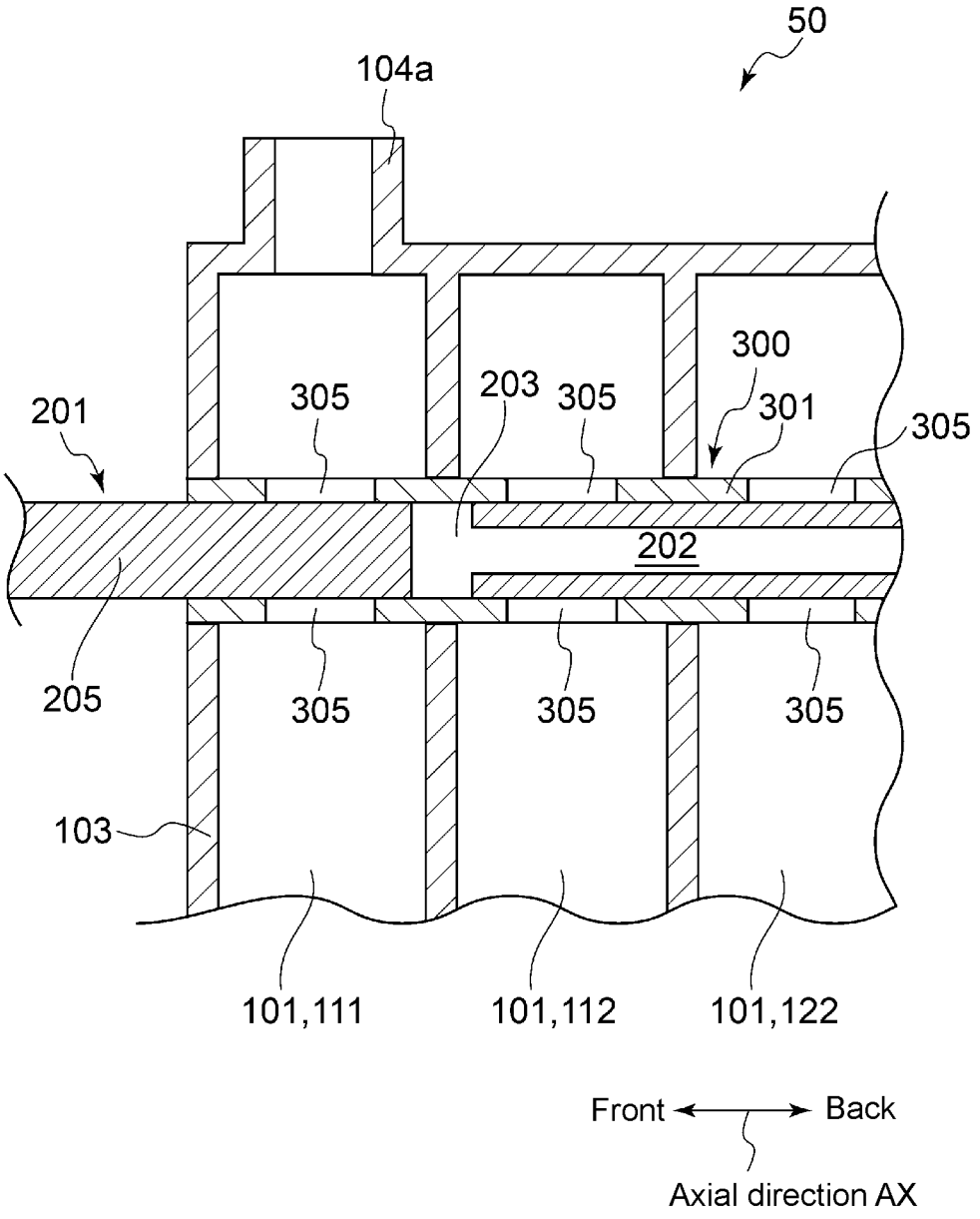
FIG. 6C is a partial enlarged view of FIG. 4.

FIGS. 6A, 6B, and 6C are each a partial enlarged view of FIG. 4.

Figure 6D:
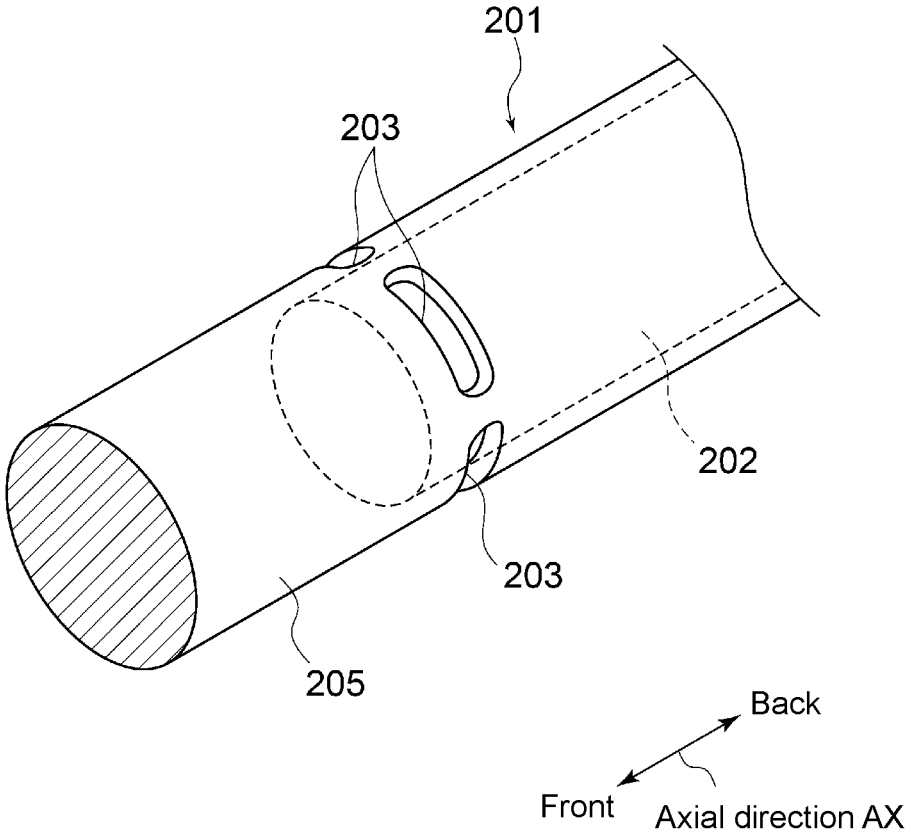
FIG. 6D is a schematic perspective view for describing the structure of a communication tube.

FIG. 6D is a schematic perspective view for describing the structure of a communication tube.

The heat exchanger passage switching device 50 according to some embodiments includes at least one chamber 101 and at least one communication tube 201. In the embodiment shown in FIGS. 3 to 5, the heat exchanger passage switching device 50 includes four chambers 101 and four communication tubes 201.

The heat exchanger passage switching device 50 according to some embodiments may be arranged at a distance along the axial direction AX of the communication tube 201 by a protrusion length of a fixed tube 300, which will be described later, from the heat exchanger 10 which is the target of passage switching.

In the following description, the axial direction AX of the communication tube 201, which is the extension direction of the communication tube 201, may simply be referred to as the axial direction AX. Further, in the following description, one side along the axial direction AX, the side opposite to the heat exchanger 10 across the chamber, is defined as the front side, and the other side along the axial direction AX is defined as the back side.

In the heat exchanger passage switching device 50 according to some embodiments, as shown in FIG. 3, the dimension D of the heat exchanger passage switching device 50 in the axial direction AX is smaller than the dimensions W, F in the directions perpendicular to the axial direction AX. In the heat exchanger passage switching device 50 according to some embodiments, as shown in FIGS. 4 and 5, multiple chambers 101 are stacked along the axial direction AX. Therefore, the dimension d of each chamber 101 in the axial direction AX is smaller than the dimension D of the heat exchanger passage switching device 50 in the axial direction AX. Therefore, the dimension d of each chamber 101 in the axial direction AX is smaller than the dimensions W, F in the directions perpendicular to the axial direction AX.

In the heat exchanger passage switching device 50 according to some embodiments, the communication tube 201 has an internal passage 202 extending along the axial direction AX of the communication tube 201 and one or more communication holes 203 communicating with the internal passage 202 (see FIG. 6D). The communication hole 203 penetrates between the inner peripheral surface of the communication tube 201, i.e., the inner wall surface constituting the internal passage 202 and the outer peripheral surface of the communication tube 201 along the radial direction of the communication tube 201. A plurality of communication holes 203 may be provided along the circumferential direction of the communication tube 201.

In the heat exchanger passage switching device 50 according to some embodiments, the internal passage 202 extends to the back end surface of the communication tube 201 and forms an opening 204 at this end surface. In the heat exchanger passage switching device 50 according to some embodiments, the internal passage 202 communicates with the interior of a fixed tube 300, which will be described later, at the opening 204.

The communication tube 201 has a front shaft portion 205 that can protrude frontward from a front surface of a housing 103 that forms the frontmost chamber 101.

In the heat exchanger passage switching device 50 according to some embodiments, the worker can change the relative position of the communication tube 201 with respect to the chamber in the axial direction AX by moving the front shaft portion 205 along the axial direction AX.

In the heat exchanger passage switching device 50 according to some embodiments, each chamber 101 has an insertion hole 102 into which the communication tube 201 is inserted to slidably support the communication tube 201 inserted in the insertion hole 102.

More specifically, each chamber 101 has at least one fixed tube 300 which is fixed to each chamber 101 and inside which the insertion hole 102 is formed. The at least one fixed tube 300 has a through hole 305 formed for each chamber 101 and penetrating a tube wall 301 of the fixed tube 300 to allow communication between the insertion hole 102 and each chamber 101. When moved to a relative position where any of the through holes 305 overlaps the one or more communication holes 203, the communication tube 201 allows communication between the internal passage 202 and the chamber 101 corresponding to the through hole 305 that overlaps the communication hole 203, and blocks communication between the internal passage 202 and the chamber 101 corresponding to the through hole 305 that does not overlap the communication hole 203.

In the heat exchanger passage switching device 50 according to some embodiments, only one chamber 101 can communicate with the internal passage 202, and the chamber 101 communicating with the internal passage 202 can be switched by changing the relative position.

Thus, in the heat exchanger passage switching device 50 according to some embodiments, the communication tube 201 is capable of switching the communication state between the communication hole 203 and the chamber 101 by the relative position of the communication tube 201 to the chamber 101 in the axial direction AX.

For example, in the state shown in FIGS. 4 and 6A, the chamber 101 that communicates with the internal passage 202 is only the frontmost chamber 101. For example, in the state shown in FIG. 6B, the chamber 101 that communicates with the internal passage 202 is only the second chamber 101 counting from the front side.

As shown in FIG. 6C, when the relative position is changed so that the communication hole 203 overlaps none of the through holes 305, the internal passage 202 is blocked from communicating with all the chambers 101.

In the heat exchanger passage switching device 50 according to some embodiments, the fixed tube 300 protrudes backward from a back surface of a housing 103 that forms the backmost chamber 101. The backward protruding end of the fixed tube 300 is connected to, for example, a surface 13 of the heat exchanger core 1 facing the front side, or a header pipe (not shown) protruding from the outer surface. In the heat exchanger passage switching device 50 according to some embodiments, the fixed tube 300 communicates with any of the header passages 4, 5, 6, 7 of the heat exchanger core 1.

As described above, since the internal passage 202 communicates with the interior of the fixed tube 300 at the opening 204, the internal passage 202 communicates with any of the header passages 4, 5, 6, 7 of the heat exchanger core 1.

(Illustrative Example of Passage Switching)

Hereinafter, as shown in FIGS. 4 and 5, the passage switching when the heat exchanger passage switching device 50 has four communication tubes 201 and four chambers 101 will be described specifically.

Here, the fluid flow will be described separately for a first passage group G1 including two communication tubes 201 and two chambers 101 of the four communication tubes 201 and four chambers 101, and a second passage group G2 including the other two communication tubes 201 and two chambers 101.

In FIGS. 4 and 5, two chambers 101 on the front side and two communication tubes 201 on the left side in the figures belong to the first passage group G1, and two chambers 101 on the back side and two communication tubes 201 on the right side in the figures belong to the second passage group G2.

Of the two chambers 101 on the front side belonging to the first passage group G1, the frontmost chamber 101 is referred to as a 1-1 chamber 111, and the second chamber 101 counted from the front side is referred to as a 1-2 chamber 112. Of the two chambers 101 on the back side belonging to the second passage group G2, the backmost chamber 101 is referred to as a 2-1 chamber 121, and the second chamber 101 counted from the back side is referred to as a 2-2 chamber 122.

The 1-1 chamber 111 of the first passage group G1 is provided with an inflow portion 104*a* for inflow of a fluid from the outside, and the first fluid is introduced from the outside thereto. Further, the 1-2 chamber 112 is provided with a discharge portion 105*a* for discharge of a fluid in the 1-2 chamber 112 to the outside.

The internal passage 202 of one communication tube 201 (1-1 communication tube 211) of the two communication tubes 201 of the first passage group G1 is connected to the first fluid first header passage 4 of the heat exchanger 10, and the internal passage 202 of the other communication tube 201 (1-2 communication tube 212) is connected to the first fluid second header passage 5 of the heat exchanger 10.

The 2-1 chamber 121 of the second passage group G2 is provided with an inflow portion 104*b* for inflow of a fluid from the outside, and the second fluid is introduced from the outside thereto. Further, the 2-2 chamber 122 is provided with a discharge portion 105*b* for discharge of a fluid in the 2-2 chamber 122 to the outside.

The internal passage 202 of one communication tube 201 (2-1 communication tube 221) of the two communication tubes 201 of the second passage group G2 is connected to the second fluid first header passage 6 of the heat exchanger 10, and the internal passage 202 of the other communication tube 201 (2-2 communication tube 222) is connected to the second fluid second header passage 7 of the heat exchanger 10.

Figure 7A:
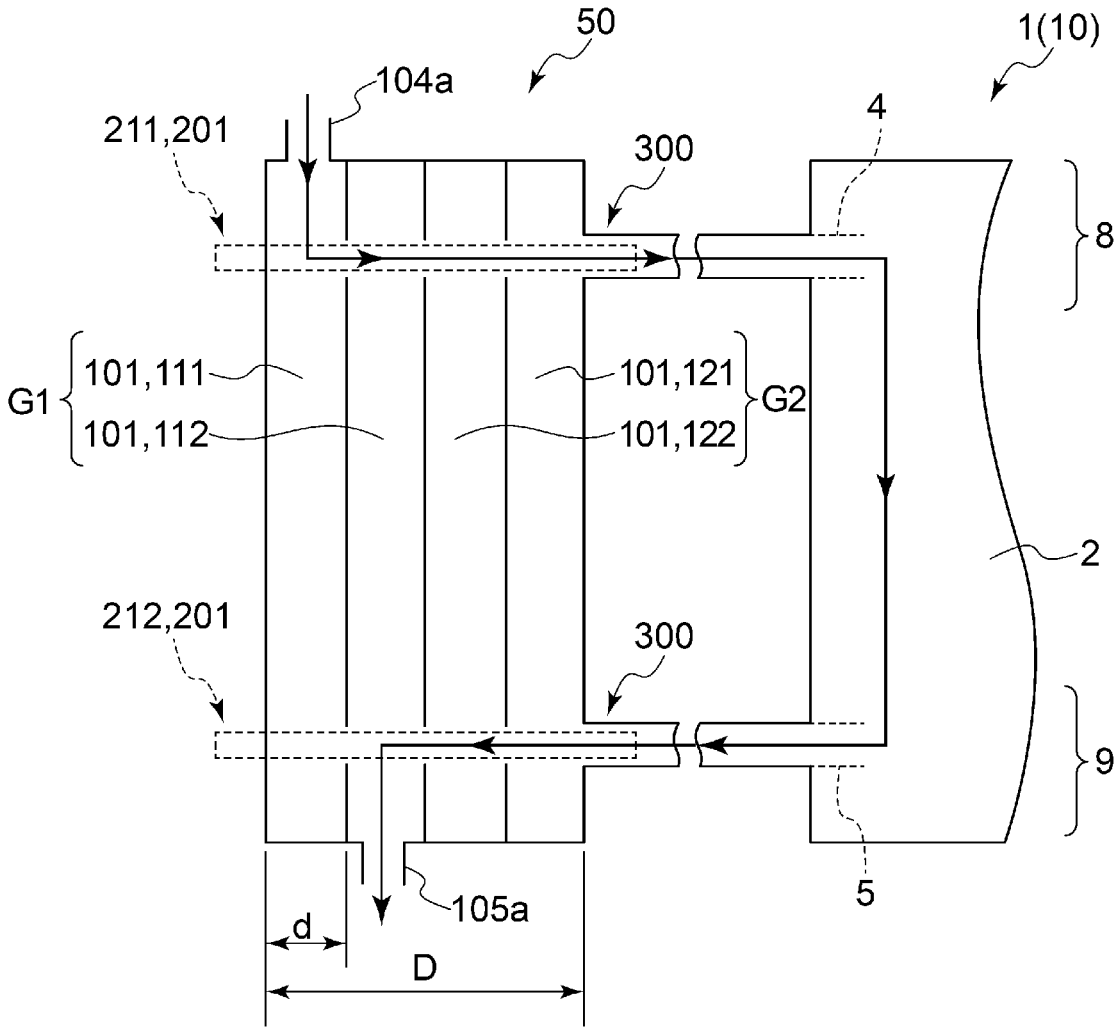
FIG. 7A is a conceptual diagram for describing the flow of fluid.

FIG. 7A is a conceptual diagram for describing the flow of fluid and corresponds to FIG. 4 which is the cross-sectional view IV of FIG. 3.

Figure 7B:
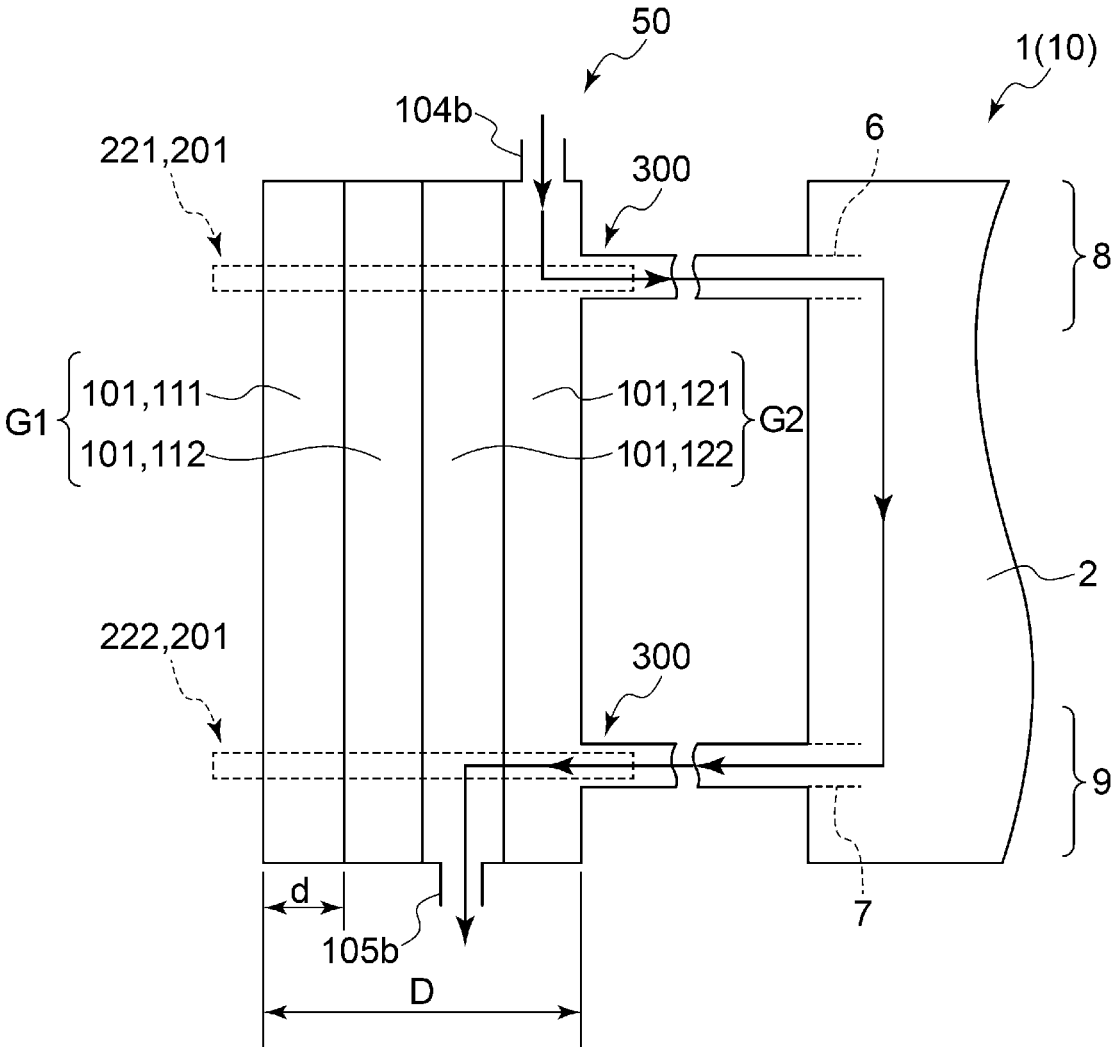
FIG. 7B is a conceptual diagram for describing the flow of fluid.

FIG. 7B is a conceptual diagram for describing the flow of fluid and corresponds to FIG. 5 which is the cross-sectional view V of FIG. 3.

Figure 8A:
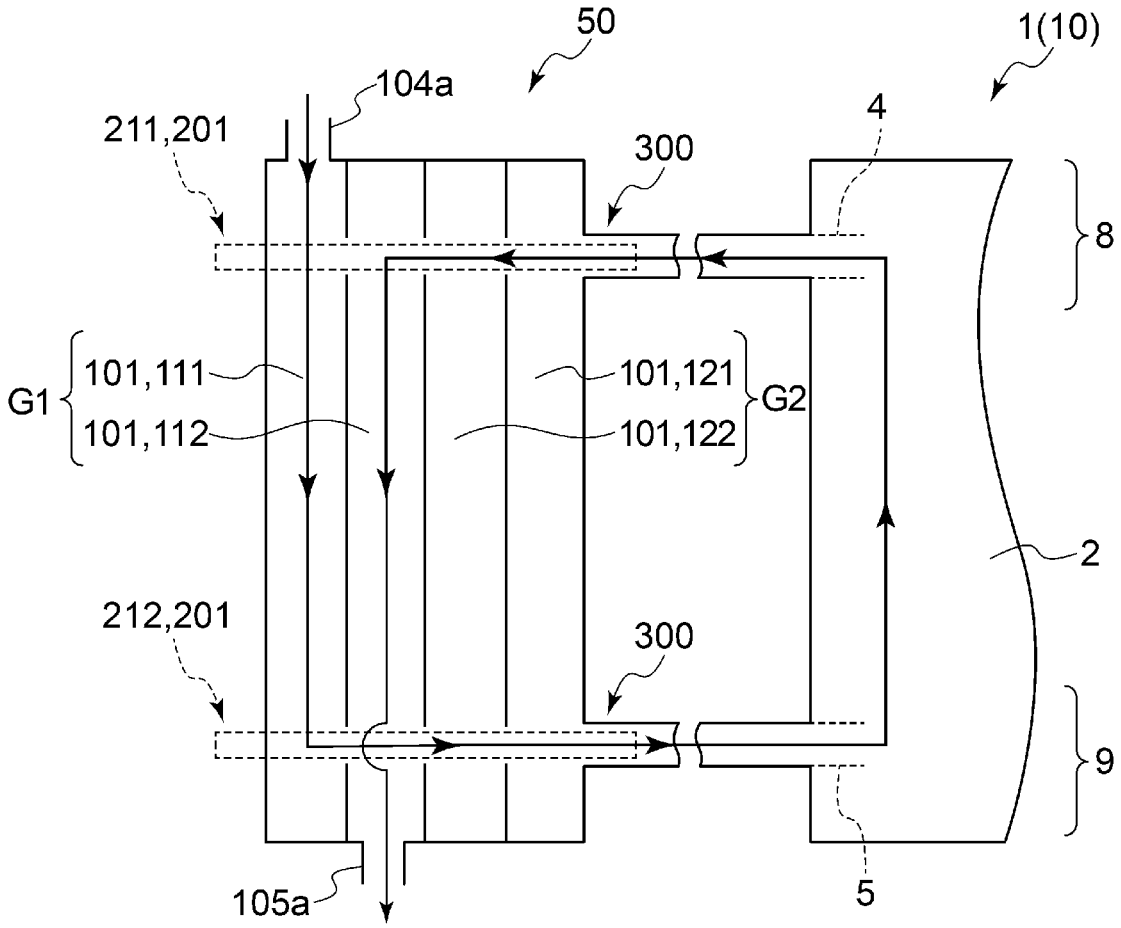
FIG. 8A is a conceptual diagram for describing the flow of fluid.

FIG. 8A is a conceptual diagram for describing the flow of fluid and corresponds to FIG. 4 which is the cross-sectional view IV of FIG. 3.

Figure 8B:
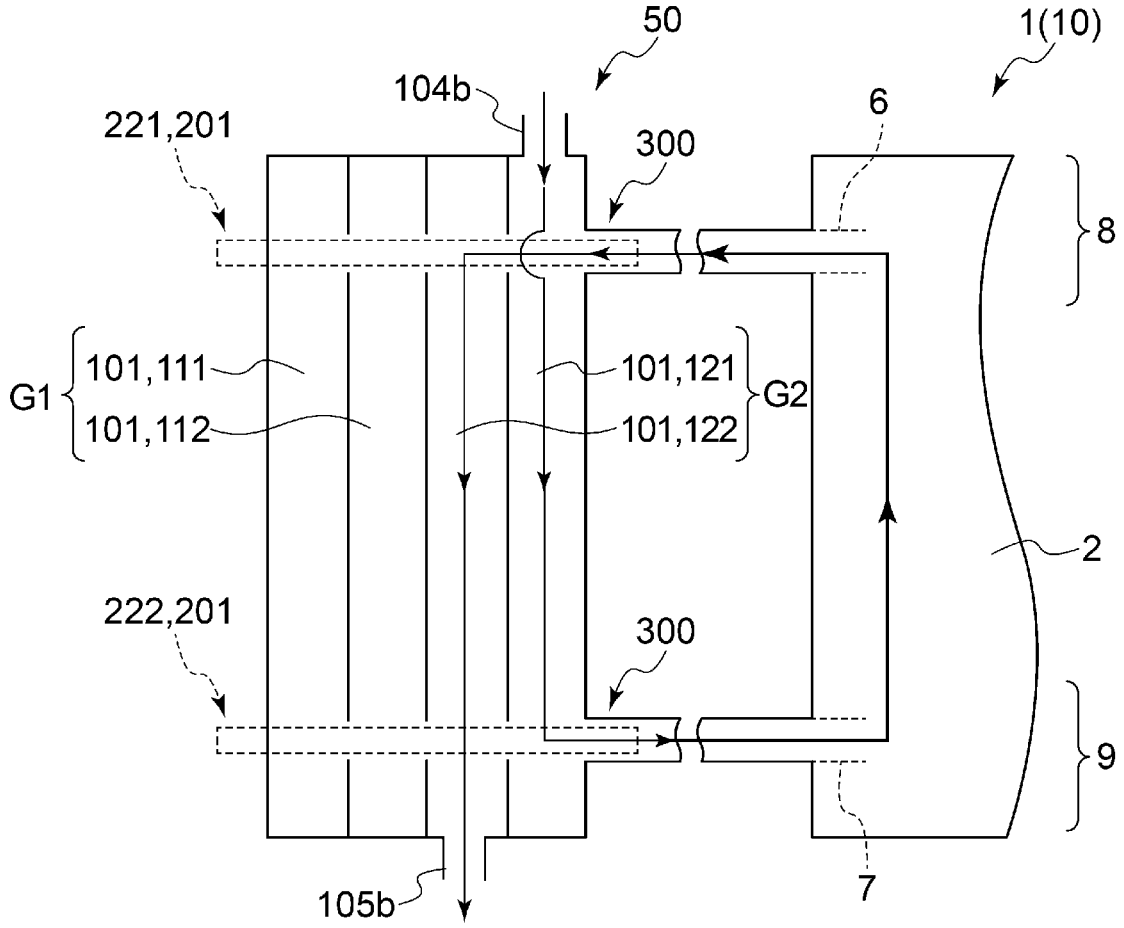
FIG. 8B is a conceptual diagram for describing the flow of fluid.

FIG. 8B is a conceptual diagram for describing the flow of fluid and corresponds to FIG. 5 which is the cross-sectional view V of FIG. 3.

In such a case, the flow of fluid when the internal passage 202 of the 1-1 communication tube 211 of the first passage group G1 communicates with the 1-1 chamber 111, and the internal passage 202 of the 1-2 communication tube 212 communicates with the 1-2 chamber 112 is as follows.

As shown in FIG. 7A, the first fluid introduced from the outside through the inflow portion 104*a* to the 1-1 chamber 111 flows through the internal passage 202 of the 1-1 communication tube 211 and then the first fluid first header passage 4, the first passage 21, and the first fluid second header passage 5 in the heat exchanger 10 in this order. Then, the fluid flowing out of the first fluid second header passage 5 flows through the internal passage 202 of the 1-2 communication tube 212 into the 1-2 chamber 112 and is then discharged from the 1-2 chamber 112 through the discharge portion 105*a* to the outside.

Further, the flow of fluid when the internal passage 202 of the 1-1 communication tube 211 communicates with the 1-2 chamber 112, and the internal passage 202 of the 1-2 communication tube 212 communicates with the 1-1 chamber 111 is as follows.

As shown in FIG. 8A, the first fluid introduced from the outside through the inflow portion 104*a* to the 1-1 chamber 111 flows through the internal passage of the 1-2 communication tube 212 and then the first fluid second header passage 5, the first passage 21, and the first fluid first header passage 4 in the heat exchanger 10 in this order. Then, the fluid flowing out of the first fluid first header passage 4 flows through the internal passage 202 of the 1-1 communication tube 211 into the 1-2 chamber 112 and is then discharged from the 1-2 chamber 112 through the discharge portion 105*a* to the outside.

Thus, according to some embodiments, by changing the relative position of the communication tube 201 to the chamber 101 in the axial direction AX, the flow of the first fluid in the first passage 21 can be reversed without changing the 1-1 chamber 111 to which the first fluid is introduced from the outside and the 1-2 chamber 112 from which the fluid is discharged to the outside.

The flow of fluid when the internal passage 202 of the 2-1 communication tube 221 of the second passage group G2 communicates with the 2-1 chamber 121, and the internal passage 202 of the 2-2 communication tube 222 communicates with the 2-2 chamber 122 is as follows.

As shown in FIG. 7B, the second fluid introduced from the outside through the inflow portion 104*b* to the 2-1 chamber 121 flows through the internal passage 202 of the 2-1 communication tube 221 and then the second fluid first header passage 6, the second passage 22, and the second fluid second header passage 7 in the heat exchanger 10 in this order. Then, the fluid flowing out of the second fluid second header passage 7 flows through the internal passage 202 of the 2-2 communication tube 222 into the 2-2 chamber 122 and is then discharged from the 2-2 chamber 122 through the discharge portion 105*b* to the outside.

The flow of fluid when the internal passage 202 of the 2-1 communication tube 221 communicates with the 2-2 chamber 122, and the internal passage 202 of the 2-2 communication tube 222 communicates with the 2-1 chamber 121 is as follows.

As shown in FIG. 8B, the second fluid introduced from the outside through the inflow portion 104*b* to the 2-1 chamber 121 flows through the internal passage 202 of the 2-2 communication tube 222 and then the second fluid second header passage 7, the second passage 22, and the second fluid first header passage 6 in the heat exchanger 10 in this order. Then, the fluid flowing out of the second fluid first header passage 6 flows through the internal passage 202 of the 2-1 communication tube 221 into the 2-2 chamber 122 and is then discharged from the 2-2 chamber 122 through the discharge portion 105*b* to the outside.

Thus, according to some embodiments, by changing the relative position of the communication tube 201 to the chamber 101 in the axial direction AX, the flow of the second fluid in the second passage 22 can be reversed without changing the 2-1 chamber 121 to which the second fluid is introduced from the outside and the 2-2 chamber 122 from which the fluid is discharged to the outside.

In some embodiments, when the passage switching state in the first passage group G1 is the state shown in FIG. 7A while the passage switching state in the second passage group G2 is the state shown in FIG. 7B, or when the passage switching state in the first passage group G1 is the state shown in FIG. 8A while the passage switching state in the second passage group G2 is the state shown in FIG. 8B, the flows of the first fluid and the second fluid in the heat exchanger core 1 are parallel flow.

Further, in some embodiments, when the passage switching state in the first passage group G1 is the state shown in FIG. 7A while the passage switching state in the second passage group G2 is the state shown in FIG. 8B, or when the passage switching state in the first passage group G1 is the state shown in FIG. 8A while the passage switching state in the second passage group G2 is the state shown in FIG. 7B, the flows of the first fluid and the second fluid in the heat exchanger core 1 are counter flow.

Further, according to some embodiments, by switching the communication state between the 1-1 chamber 111 and the 1-2 chamber 112 of the first passage group G1 and the 2-1 communication tube 221 and the 2-2 communication tube 222 of the second passage group G2, the first fluid can be circulated through the second passage 22, and the flow of the first fluid in the second passage 22 can be reversed, without changing the 1-1 chamber 111 to which the first fluid is introduced from the outside and the 1-2 chamber 112 from which the fluid is discharged to the outside.

Similarly, according to some embodiments, by switching the communication state between the 2-1 chamber 121 and the 2-2 chamber 122 of the second passage group G2 and the 1-1 communication tube 211 and the 1-2 communication tube 212 of the first passage group G1, the second fluid can be circulated through the first passage 21, and the flow of the second fluid in the first passage 21 can be reversed, without changing the 2-1 chamber 121 to which the second fluid is introduced from the outside and the 2-2 chamber 122 from which the fluid is discharged to the outside.

In the embodiment shown in FIG. 3, four chambers 101 are stacked along the axial direction AX, but two chambers 101 of the four chambers 101 may constitute a first switching unit 51 for switching the flow of the first fluid, and the other two chambers 101 may constitute a second switching unit 52 for switching the flow of the second fluid.

Figure 9:
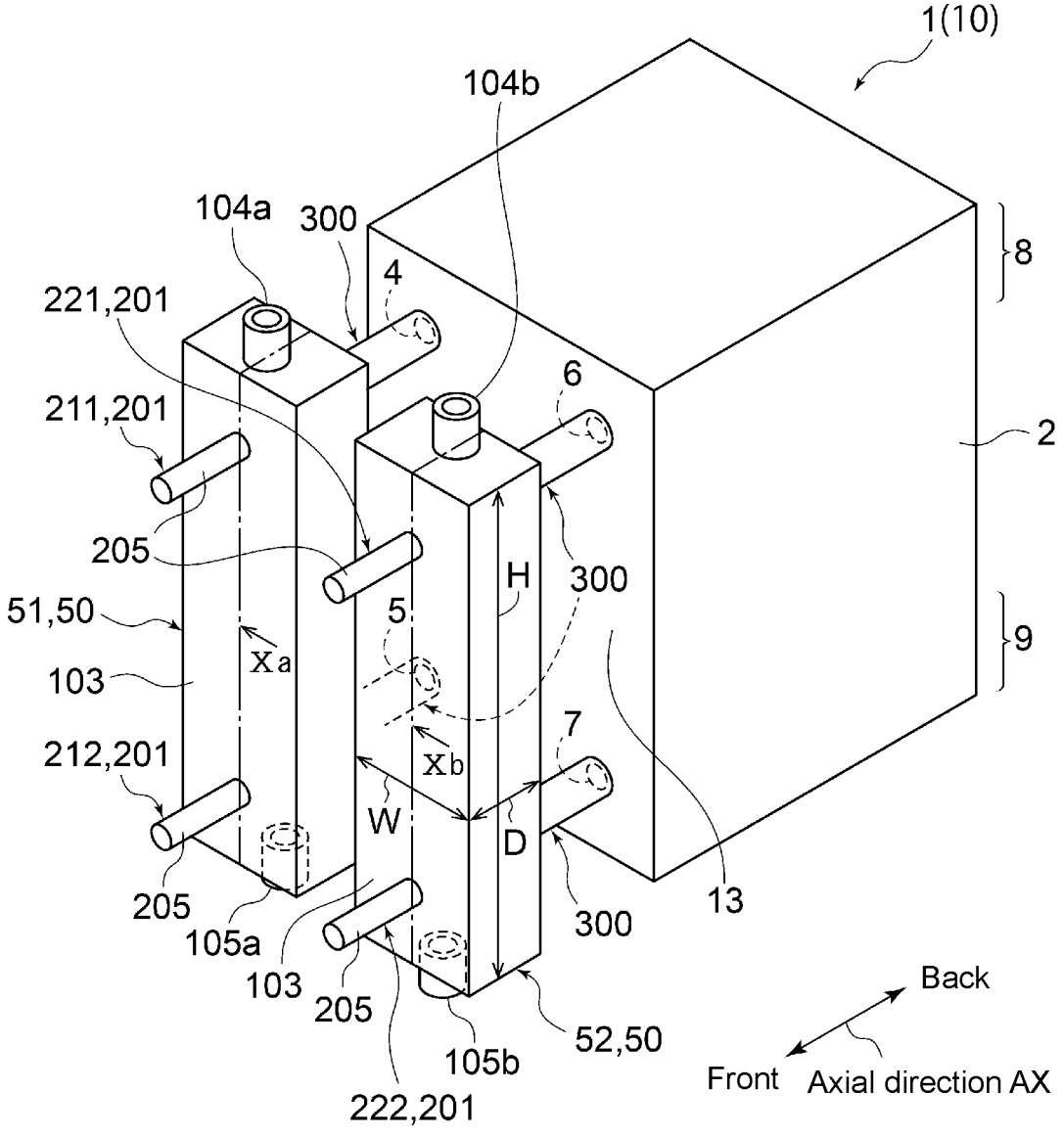
FIG. 9 is a perspective view of a schematic appearance of a heat exchanger passage switching device having a first switching unit and a second switching unit.

FIG. 9 is a perspective view of a schematic appearance of a heat exchanger passage switching device 50 having a first switching unit and a second switching unit.

Figure 10A:
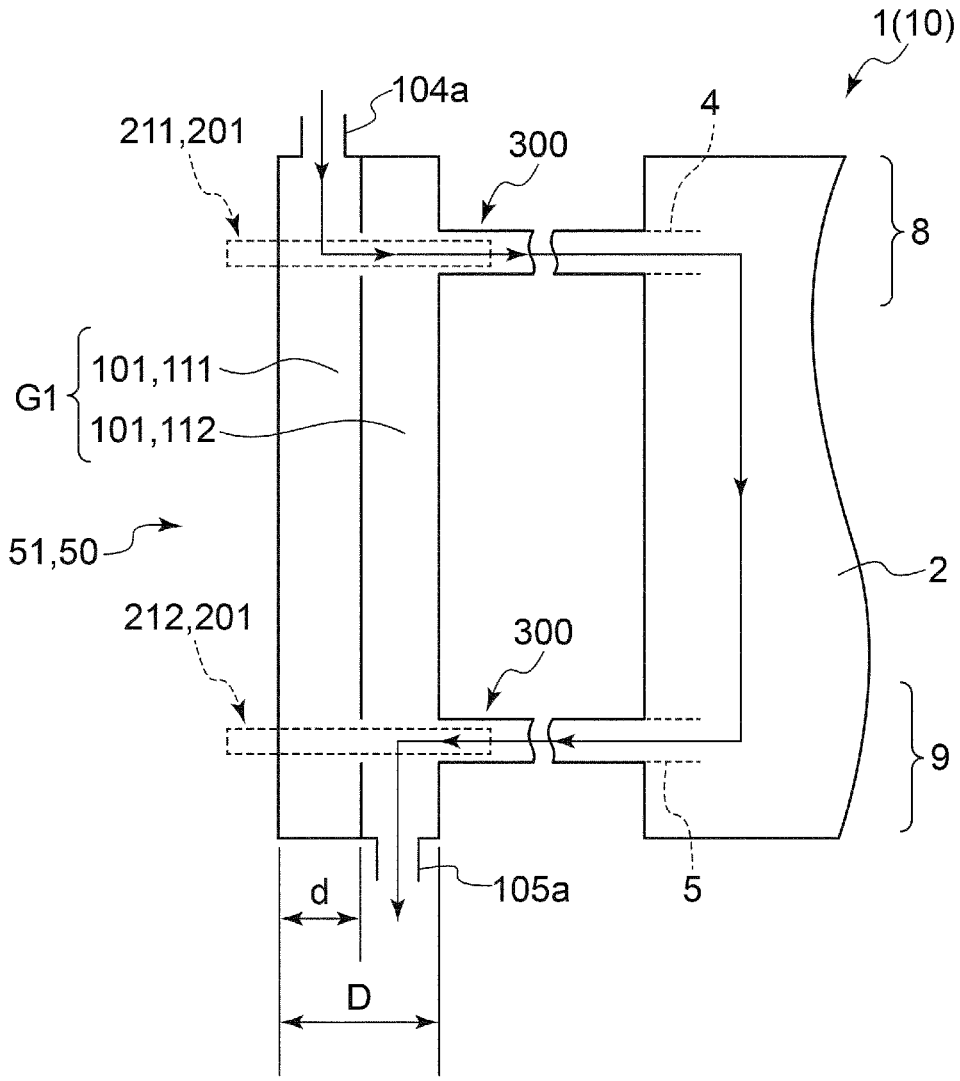
FIG. 10A is a conceptual diagram for describing the flow of fluid.

FIG. 10A is a conceptual diagram for describing the flow of fluid and shows the cross-sectional view Xa of FIG. 9.

Figure 10B:
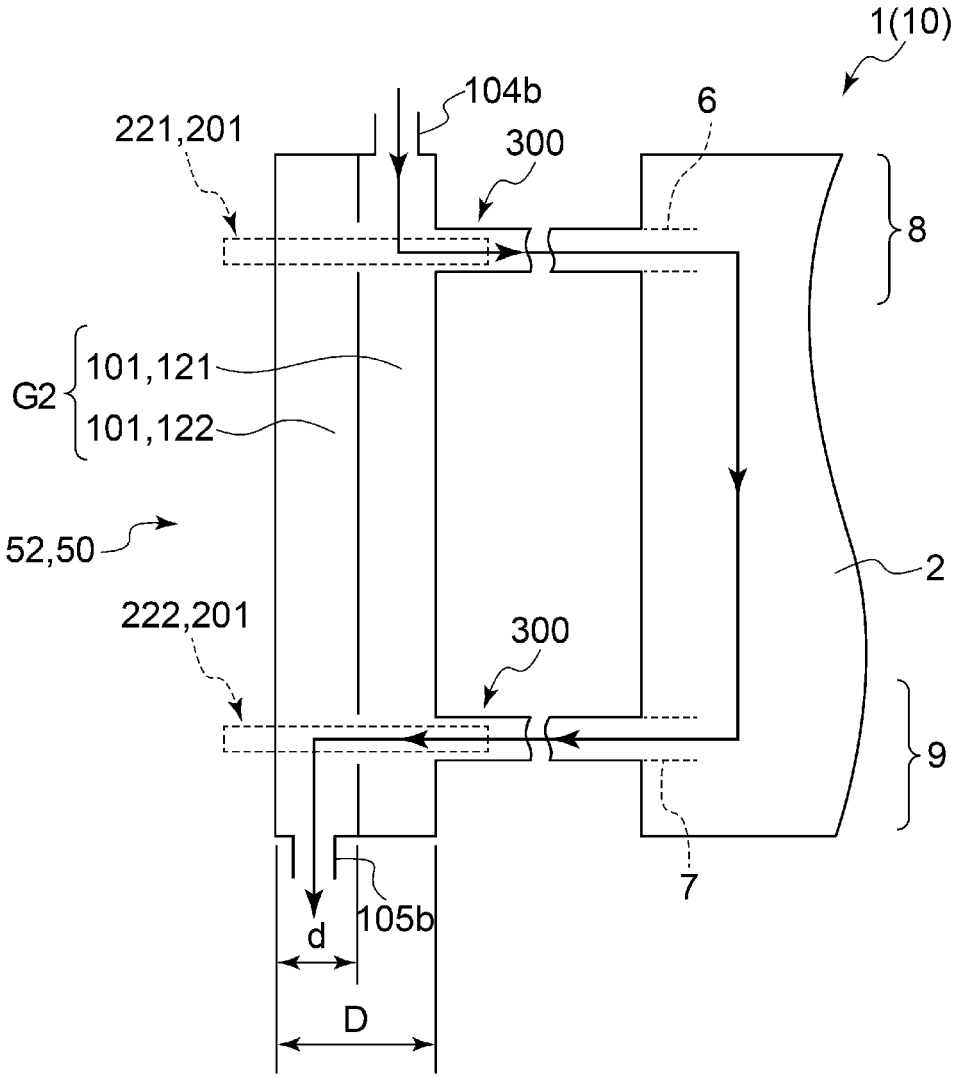
FIG. 10B is a conceptual diagram for describing the flow of fluid.

FIG. 10B is a conceptual diagram for describing the flow of fluid and shows the cross-sectional view Xb of FIG. 9.

Figure 11A:
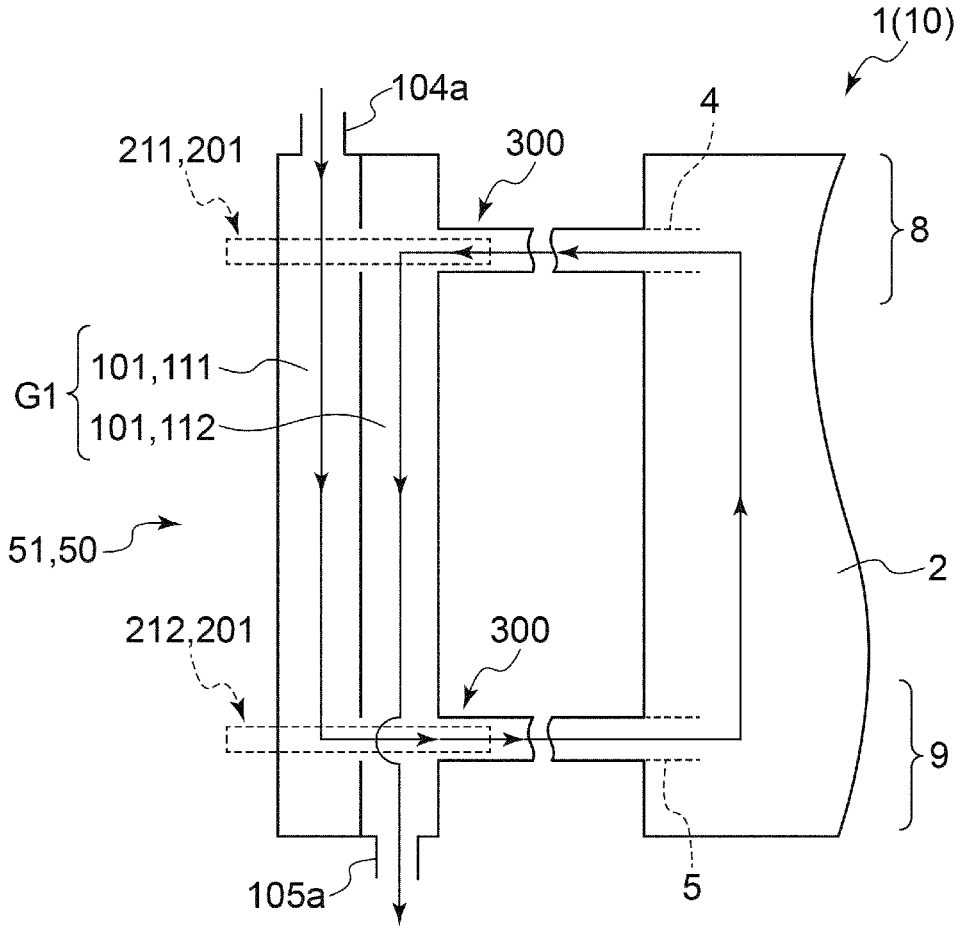
FIG. 11A is a conceptual diagram for describing the flow of fluid.

FIG. 11A is a conceptual diagram for describing the flow of fluid and shows the cross-sectional view Xa of FIG. 9.

Figure 11B:
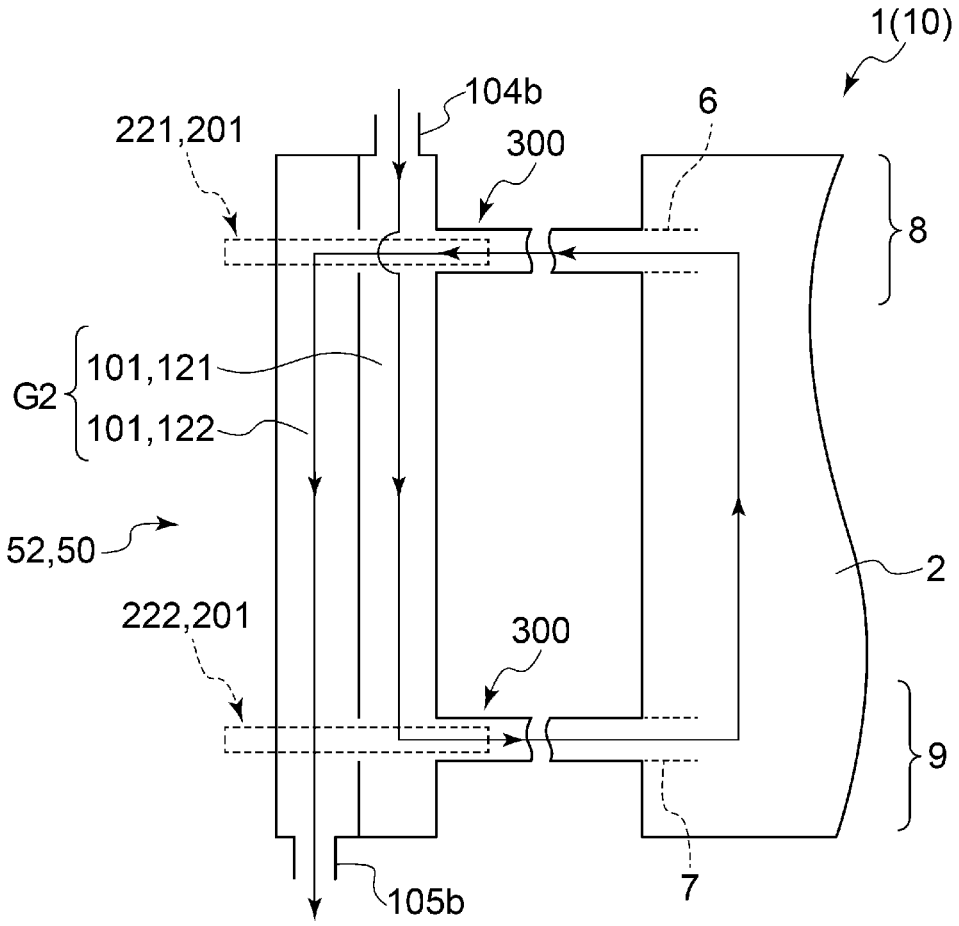
FIG. 11B is a conceptual diagram for describing the flow of fluid.

FIG. 11B is a conceptual diagram for describing the flow of fluid and shows the cross-sectional view Xb of FIG. 9.

The heat exchanger passage switching device 50 shown in FIG. 9 is provided with a first switching unit 51 and a second switching unit 52 each of which includes two communication tubes 201 and two chambers 101 stacked along the axial direction AX. The first switching unit 51 and the second switching unit 52 are arranged at positions that do not overlap each other when viewed from the axial direction AX.

In each of the first switching unit 51 and the second switching unit 52, the two chambers 101 have two insertion holes 102 into which the two communication tubes 201 are inserted, respectively, as in the above-described embodiments.

In each of the first switching unit 51 and the second switching unit 52, each of the two communication tubes 201 is configured to select which one of the two chambers 101 to be communicated with the communication hole 203 by the relative position of the communication tube 201 to the chamber 101, as in the above-described embodiments.

For example, as described later, the first switching unit 51 may have a configuration corresponding to the above-described first passage group G1. Further, as described later, the second switching unit 52 may have a configuration corresponding to the above-described second passage group G2.

In the first switching unit 51, the chamber 101 on the front side is referred to as a 1-1 chamber 111, and the chamber 101 on the back side is referred to as a 1-2 chamber 112.

In the second switching unit 52, the chamber 101 on the back side is referred to as a 2-1 chamber 121, and the chamber 101 on the front side is referred to as a 2-2 chamber 122.

In the heat exchanger passage switching device 50 according to some embodiments, as shown in FIG. 9, the dimension D of the heat exchanger passage switching device 50 in the axial direction AX is smaller than the dimensions W, F in the directions perpendicular to the axial direction AX. In the heat exchanger passage switching device 50 according to some embodiments, as shown in FIGS. 10A and 10B, multiple chambers 101 are stacked along the axial direction AX. Therefore, the dimension d of each chamber 101 in the axial direction AX is smaller than the dimension D of the heat exchanger passage switching device 50 in the axial direction AX. Therefore, the dimension d of each chamber 101 in the axial direction AX is smaller than the dimensions W, F in the directions perpendicular to the axial direction AX.

The 1-1 chamber 111 of the first switching unit 51 is provided with an inflow portion 104*a* for inflow of a fluid from the outside, and the first fluid is introduced from the outside thereto. Further, the 1-2 chamber 112 is provided with a discharge portion 105*a* for discharge of a fluid in the 1-2 chamber 112 to the outside.

The internal passage 202 of one communication tube 201 (1-1 communication tube 211) of the two communication tubes 201 of the first switching unit 51 is connected to the first fluid first header passage 4 of the heat exchanger 10, and the internal passage 202 of the other communication tube 201 (1-2 communication tube 212) is connected to the first fluid second header passage 5 of the heat exchanger 10.

The 2-1 chamber 121 of the second switching unit 52 is provided with an inflow portion 104*b* for inflow of a fluid from the outside, and the second fluid is introduced from the outside thereto. Further, the 2-2 chamber 122 is provided with a discharge portion 105*b* for discharge of a fluid in the 2-2 chamber 122 to the outside.

The internal passage 202 of one communication tube 201 (2-1 communication tube 221) of the two communication tubes 201 of the second switching unit 52 is connected to the second fluid first header passage 6 of the heat exchanger 10, and the internal passage 202 of the other communication tube 201 (2-2 communication tube 222) is connected to the second fluid second header passage 7 of the heat exchanger 10.

In such a case, the flow of fluid when the internal passage 202 of the 1-1 communication tube 211 of the first switching unit 51 communicates with the 1-1 chamber 111, and the internal passage 202 of the 1-2 communication tube 212 communicates with the 1-2 chamber 112 is as follows.

As shown in FIG. 10A, the first fluid introduced from the outside through the inflow portion 104*a* to the 1-1 chamber 111 flows through the internal passage 202 of the 1-1 communication tube 211 and then the first fluid first header passage 4, the first passage 21, and the first fluid second header passage 5 in the heat exchanger 10 in this order. Then, the fluid flowing out of the first fluid second header passage 5 flows through the internal passage 202 of the 1-2 communication tube 212 into the 1-2 chamber 112 and is then discharged from the 1-2 chamber 112 through the discharge portion 105*a* to the outside.

Further, the flow of fluid when the internal passage 202 of the 1-1 communication tube 211 communicates with the 1-2 chamber 112, and the internal passage 202 of the 1-2 communication tube 212 communicates with the 1-1 chamber 111 is as follows.

As shown in FIG. 11A, the first fluid introduced from the outside through the inflow portion 104*a* to the 1-1 chamber 111 flows through the internal passage of the 1-2 communication tube 212 and then the first fluid second header passage 5, the first passage 21, and the first fluid first header passage 4 in the heat exchanger 10 in this order. Then, the fluid flowing out of the first fluid first header passage 4 flows through the internal passage 202 of the 1-1 communication tube 211 into the 1-2 chamber 112 and is then discharged from the 1-2 chamber 112 through the discharge portion 105*a* to the outside.

Thus, according to the embodiment shown in FIG. 9, by changing the relative position of the communication tube 201 to the chamber 101 in the axial direction AX, the flow of the first fluid in the first passage 21 can be reversed without changing the 1-1 chamber 111 to which the first fluid is introduced from the outside and the 1-2 chamber 112 from which the fluid is discharged to the outside.

The flow of fluid when the internal passage 202 of the 2-1 communication tube 221 of the second switching unit 52 communicates with the 2-1 chamber 121, and the internal passage 202 of the 2-2 communication tube 222 communicates with the 2-2 chamber 122 is as follows.

As shown in FIG. 10B, the second fluid introduced from the outside through the inflow portion 104*b* to the 2-1 chamber 121 flows through the internal passage 202 of the 2-1 communication tube 221 and then the second fluid first header passage 6, the second passage 22, and the second fluid second header passage 7 in the heat exchanger 10 in this order. Then, the fluid flowing out of the second fluid second header passage 7 flows through the internal passage 202 of the 2-2 communication tube 222 into the 2-2 chamber 122 and is then discharged from the 2-2 chamber 122 through the discharge portion 105*b* to the outside.

The flow of fluid when the internal passage 202 of the 2-1 communication tube 221 communicates with the 2-2 chamber 122, and the internal passage 202 of the 2-2 communication tube 222 communicates with the 2-1 chamber 121 is as follows.

As shown in FIG. 11B, the second fluid introduced from the outside through the inflow portion 104*b* to the 2-1 chamber 121 flows through the internal passage 202 of the 2-2 communication tube 222 and then the second fluid second header passage 7, the second passage 22, and the second fluid first header passage 6 in the heat exchanger 10 in this order. Then, the fluid flowing out of the second fluid first header passage 6 flows through the internal passage 202 of the 2-1 communication tube 221 into the 2-2 chamber 122 and is then discharged from the 2-2 chamber 122 through the discharge portion 105*b* to the outside.

Thus, according to the embodiment shown in FIG. 9, by changing the relative position of the communication tube 201 to the chamber 101 in the axial direction AX, the flow of the second fluid in the second passage 22 can be reversed without changing the 2-1 chamber 121 to which the second fluid is introduced from the outside and the 2-2 chamber 122 from which the fluid is discharged to the outside.

In some embodiments, when the passage switching state in the first switching unit 51 is the state shown in FIG. 10A while the passage switching state in the second switching unit 52 is the state shown in FIG. 10B, or when the passage switching state in the first switching unit 51 is the state shown in FIG. 11A while the passage switching state in the second switching unit 52 is the state shown in FIG. 11B, the flows of the first fluid and the second fluid in the heat exchanger core 1 are parallel flow.

Further, in some embodiments, when the passage switching state in the first switching unit 51 is the state shown in FIG. 10A while the passage switching state in the second switching unit 52 is the state shown in FIG. 11B, or when the passage switching state in the first switching unit 51 is the state shown in FIG. 11A while the passage switching state in the second switching unit 52 is the state shown in FIG. 10B, the flows of the first fluid and the second fluid in the heat exchanger core 1 are counter flow.

(Heat Exchanger Passage Switching Device Capable of Switching Passages of Multiple Heat Exchanger Cores)

Hereinafter, a heat exchanger passage switching device capable of switching passages of multiple heat exchanger cores 1 will be described.

Figure 12:
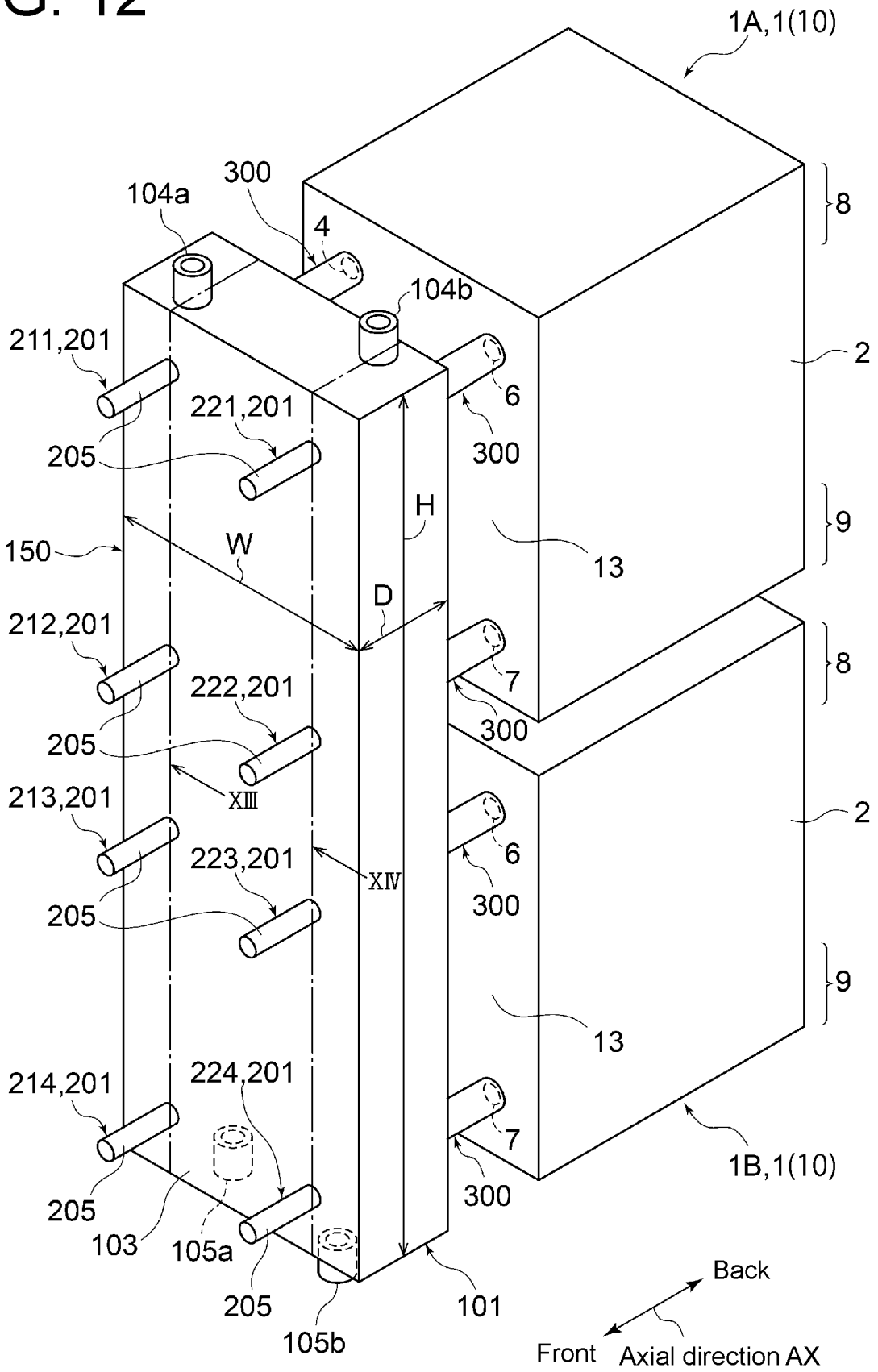
FIG. 12 is a perspective view of a schematic appearance of a heat exchanger passage switching device according to at least one embodiment of the present disclosure capable of switching passages of two heat exchanger cores.

FIG. 12 is a perspective view of a schematic appearance of a heat exchanger passage switching device 150 according to an embodiment capable of switching passages of two heat exchanger cores 1.

Figure 13A:
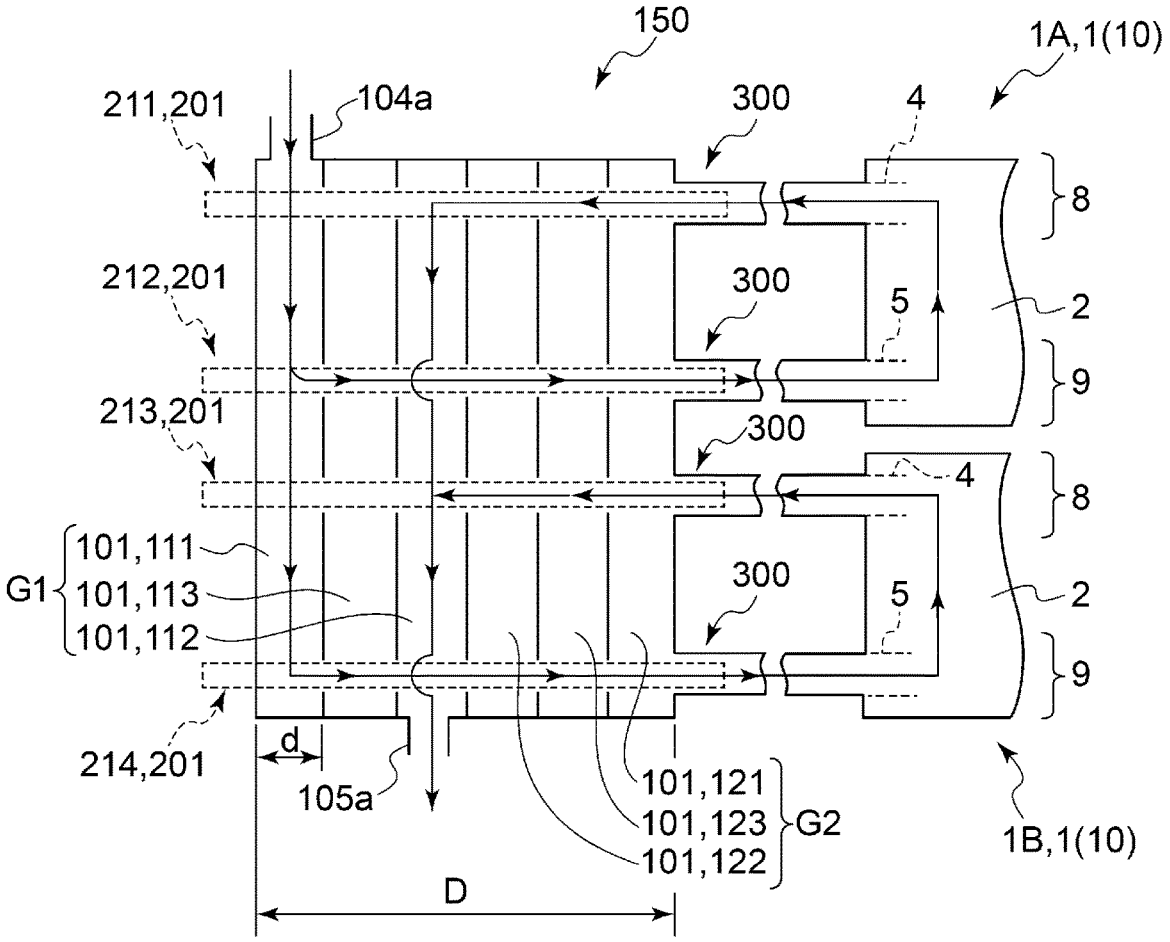
FIG. 13A is a conceptual diagram for describing the flow of fluid.

FIG. 13A is a conceptual diagram for describing the flow of fluid and corresponds to the cross-sectional view XIII of FIG. 12.

Figure 13B:
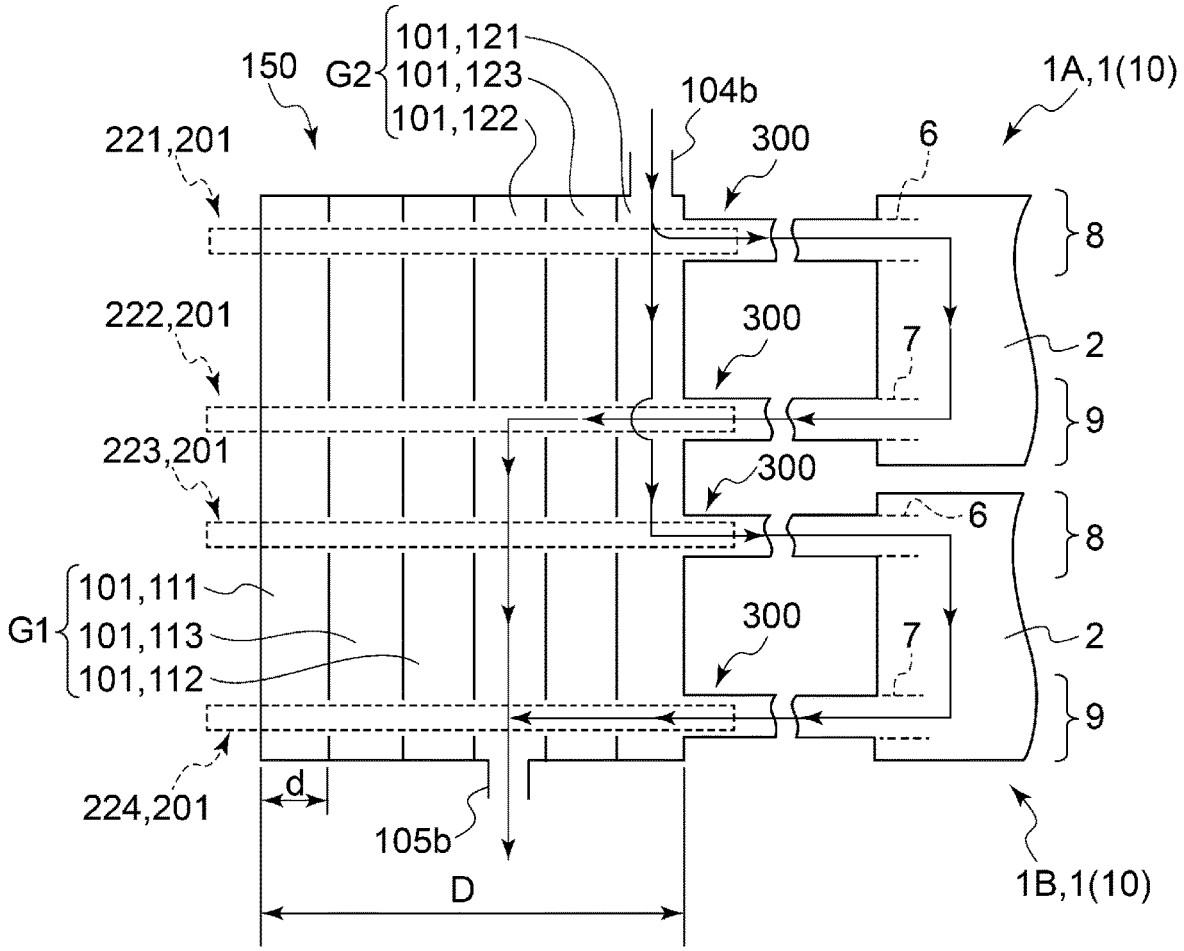
FIG. 13B is a conceptual diagram for describing the flow of fluid.

FIG. 13B is a conceptual diagram for describing the flow of fluid and corresponds to the cross-sectional view XIV of FIG. 12.

Figure 13C:
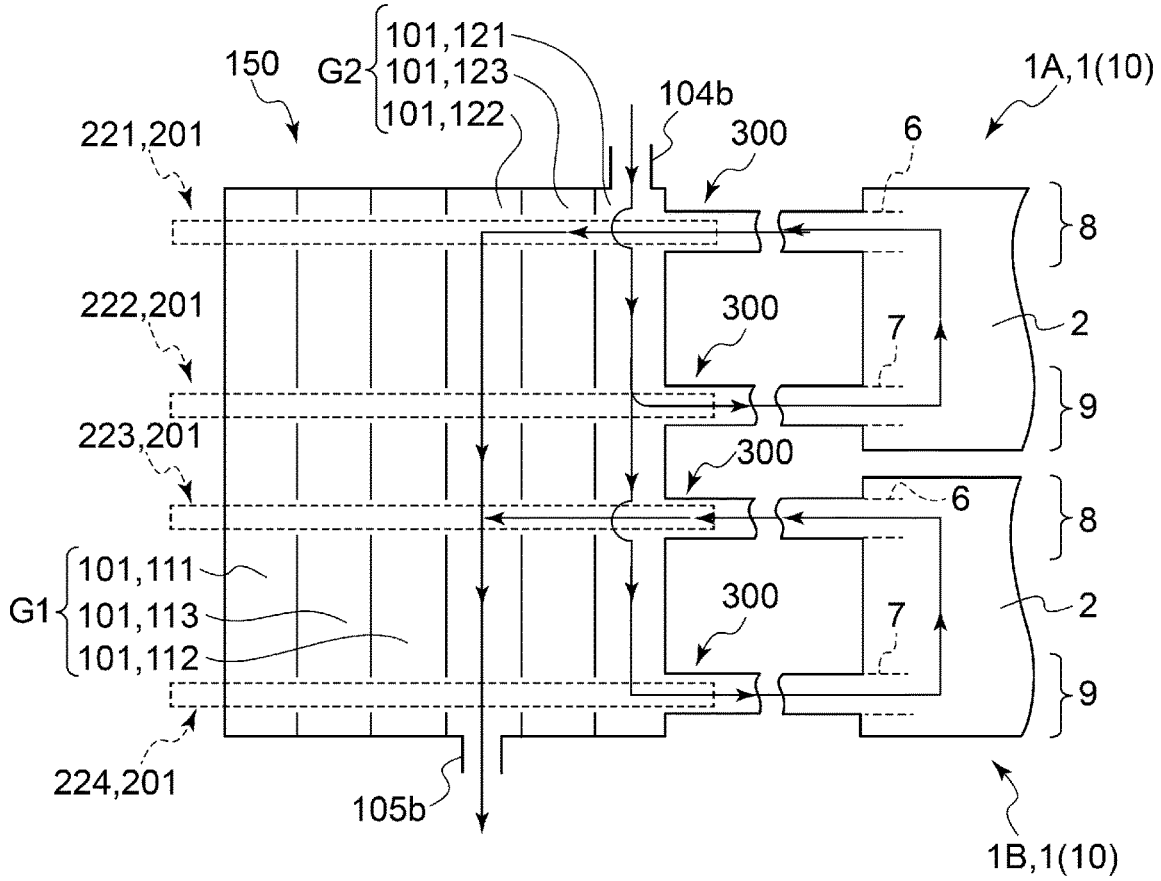
FIG. 13C is a conceptual diagram for describing the flow of fluid.

FIG. 13C is a conceptual diagram for describing the flow of fluid and corresponds to the cross-sectional view XIV of FIG. 12.

Figure 14A:
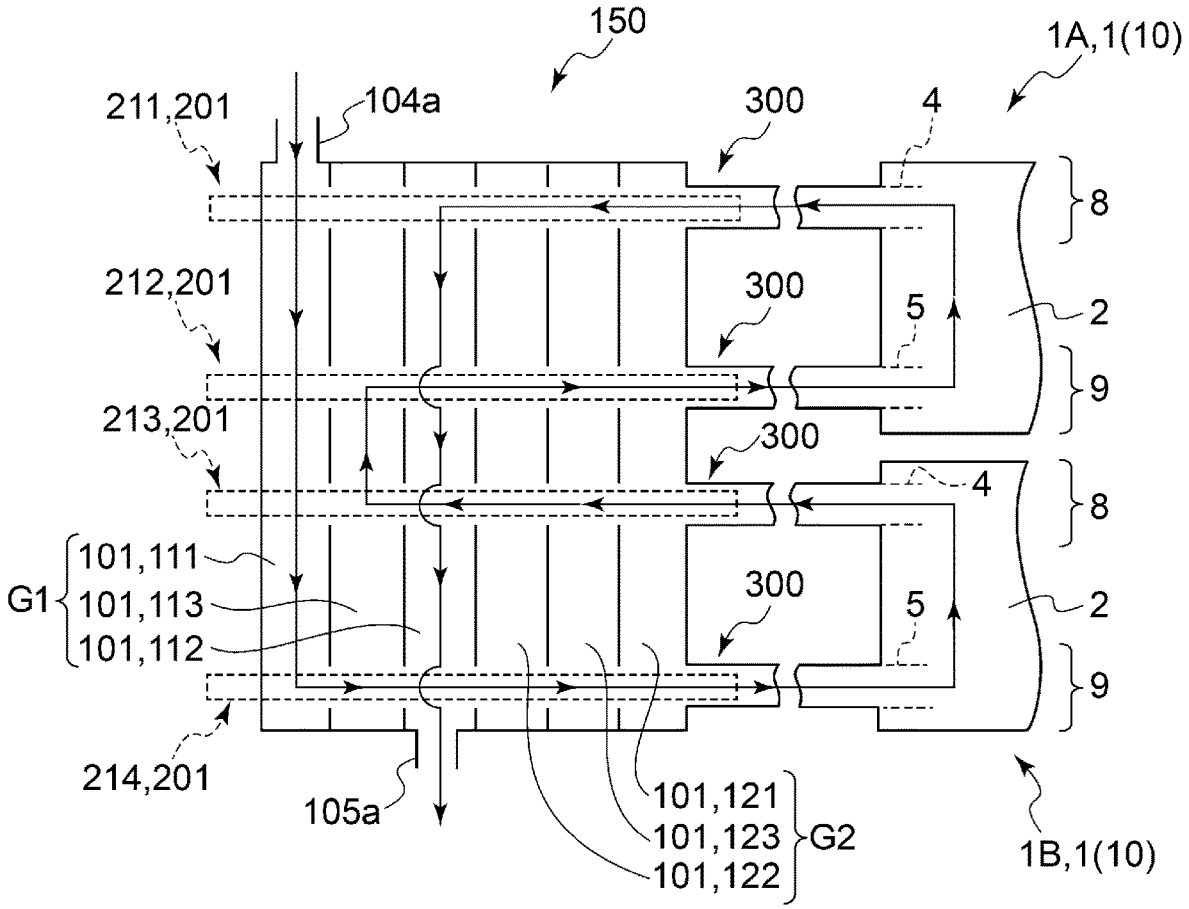
FIG. 14A is a conceptual diagram for describing the flow of fluid.

FIG. 14A is a conceptual diagram for describing the flow of fluid and corresponds to the cross-sectional view XIII of FIG. 12.

Figure 14B:
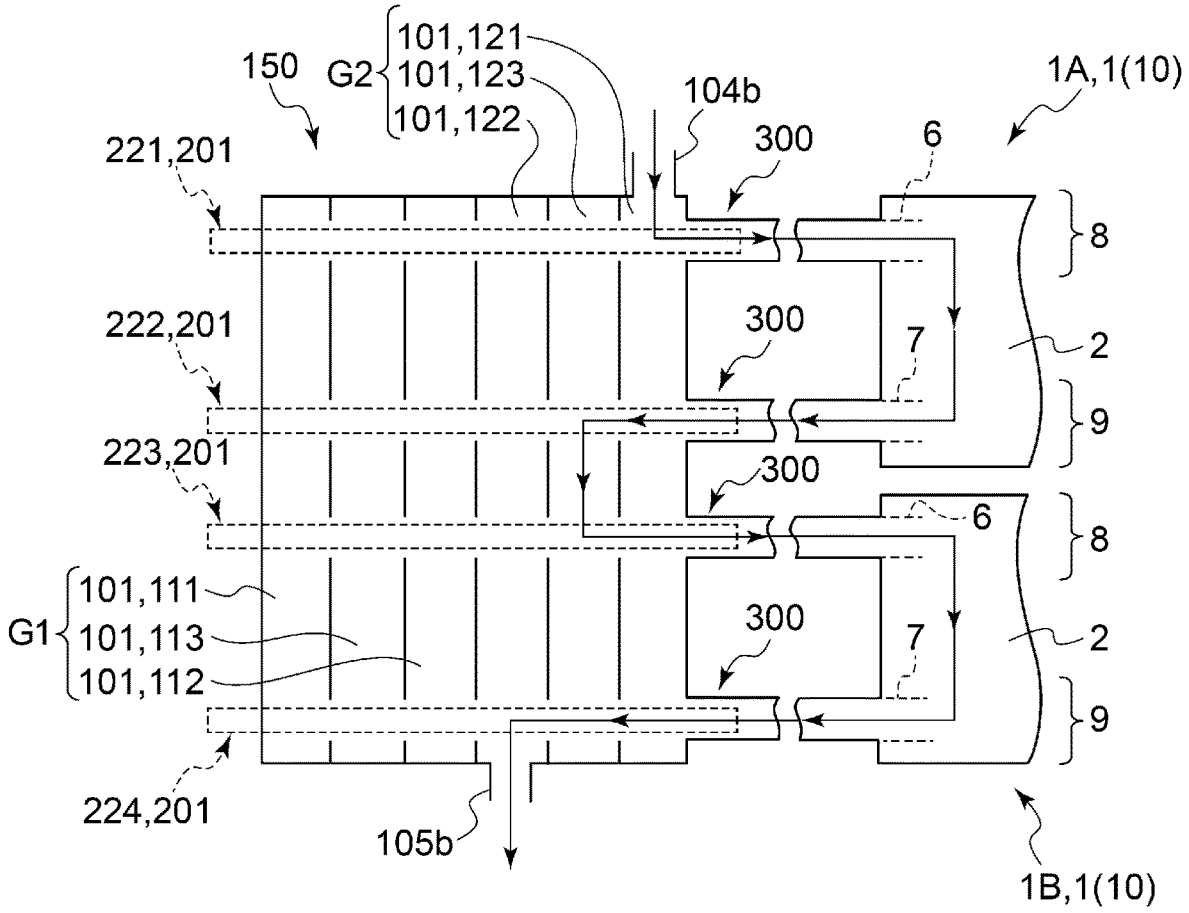
FIG. 14B is a conceptual diagram for describing the flow of fluid.

FIG. 14B is a conceptual diagram for describing the flow of fluid and corresponds to the cross-sectional view XIV of FIG. 12.

Figure 14C:
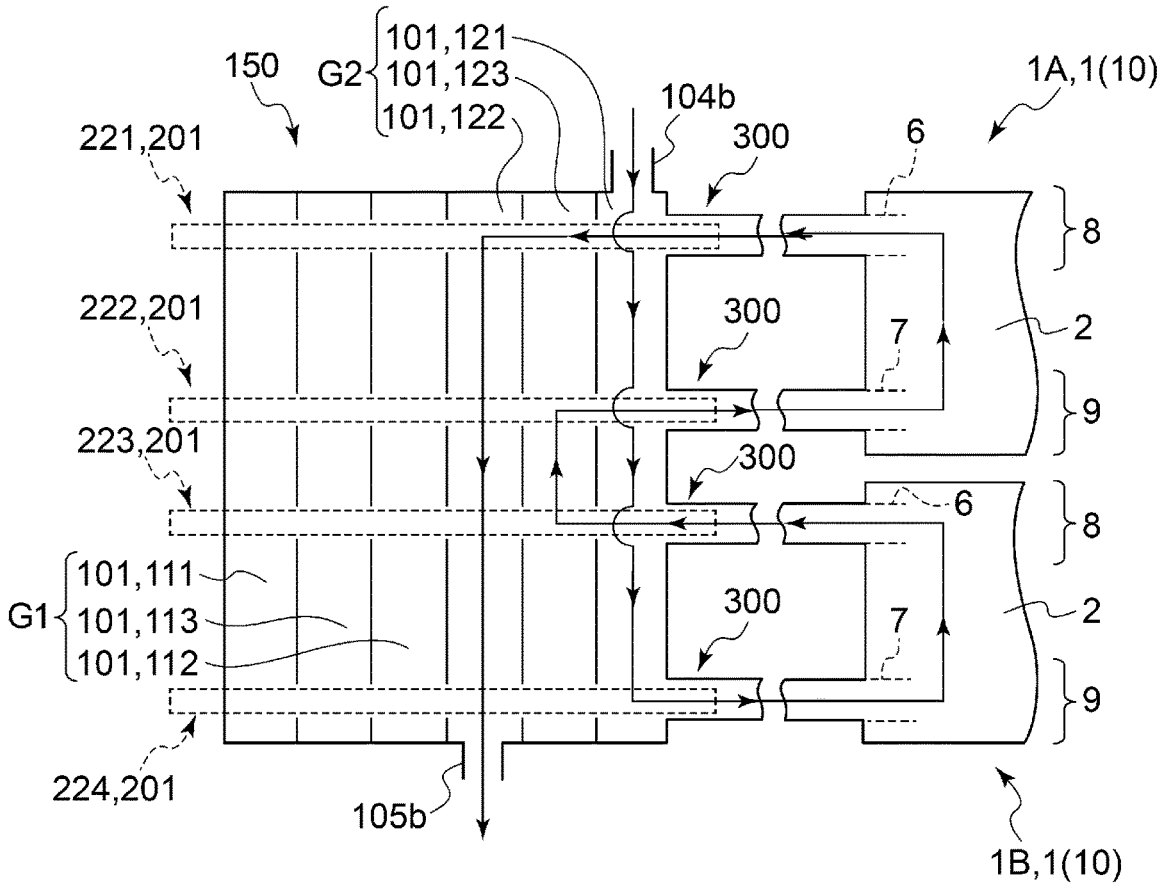
FIG. 14C is a conceptual diagram for describing the flow of fluid.

FIG. 14C is a conceptual diagram for describing the flow of fluid and corresponds to the cross-sectional view XIV of FIG. 12.

In the heat exchanger passage switching device 150 capable of switching passages of multiple heat exchanger cores 1, the same components as those of the heat exchanger passage switching device 50 shown in FIG. 3 are associated with the same reference numerals and not described again in detail.

The heat exchanger passage switching device 150 capable of switching passages of multiple heat exchanger cores 1 may include at least eight communication tubes 201 and at least six chambers 101 stacked along the axial direction AX.

The heat exchanger passage switching device 150 capable of switching passages of multiple heat exchanger cores 1 shown in FIG. 12 includes six chambers 101 and eight communication tubes 201.

In the heat exchanger passage switching device 150 according to some embodiments, as shown in FIG. 12, the dimension D of the heat exchanger passage switching device 150 in the axial direction AX is smaller than the dimensions W, F in the directions perpendicular to the axial direction AX. In the heat exchanger passage switching device 150 according to some embodiments, as shown in FIGS. 13A and 13B, multiple chambers 101 are stacked along the axial direction AX. Therefore, the dimension d of each chamber 101 in the axial direction AX is smaller than the dimension D of the heat exchanger passage switching device 50 in the axial direction AX. Therefore, the dimension d of each chamber 101 in the axial direction AX is smaller than the dimensions W, F in the directions perpendicular to the axial direction AX.

In the heat exchanger passage switching device 150 capable of switching passages of multiple heat exchanger cores 1, the at least six chambers 101 may have at least eight insertion holes 102 into which the at least eight communication tubes 201 are inserted, respectively.

Each of the at least eight communication tubes 201 may be configured to select which one of the at least six chambers 101 to be communicated with the communication hole 203 by the relative position of the communication tube 201 to the chamber 101. Specifically, as with the heat exchanger passage switching device 50 shown in FIG. 3, the device may have the same configuration as that shown in FIGS. 4, 5, and 6A to 6D.

In the heat exchanger passage switching device 150 shown in FIG. 12, the six chambers 101 have eight insertion holes 102 into which the eight communication tubes 201 are inserted, respectively.

In the heat exchanger passage switching device 150 shown in FIG. 12, each of the eight communication tubes 201 is configured to select which one of the six chambers 101 to be communicated with the communication hole 203 by the relative position of the communication tube 201 to the chamber 101.

(Illustrative Example of Passage Switching of Two Heat Exchanger Cores)

Hereinafter, the passage switching of two heat exchanger cores 1 using the heat exchanger passage switching device 150 shown in FIG. 12 will be described specifically.

Here, the fluid flow will be described separately for a first passage group G1 including four communication tubes 201 and three chambers 101 of the eight communication tubes 201 and six chambers 101, and a second passage group G2 including the other four communication tubes 201 and three chambers 101.

In FIG. 12, three chambers 101 on the front side and four communication tubes 201 on the left side in the figures belong to the first passage group G1, and three chambers 101 on the back side and four communication tubes 201 on the right side in the figures belong to the second passage group G2.

Of the three chambers 101 on the front side belonging to the first passage group G1, the frontmost chamber 101 is referred to as a 1-1 chamber 111, the third chamber 101 counted from the front side is referred to as a 1-2 chamber 112, and the second chamber 101 counted from the front side and disposed between the 1-1 chamber 111 and the 1-2 chamber 112 is referred to as a 1-3 chamber 113. Of the three chambers 101 on the back side belonging to the second passage group G2, the backmost chamber 101 is referred to as a 2-1 chamber 121, the third chamber 101 counted from the back side is referred to as a 2-2 chamber 122, and the second chamber 101 counted from the back side and disposed between the 2-1 chamber 121 and the 2-2 chamber 122 is referred to as a 2-3 chamber 123.

Of the two heat exchanger cores 1 shown in FIG. 12, the heat exchanger core 1 on the upper side in the figure is referred to as a first heat exchanger core 1A, and the heat exchanger core 1 on the lower side in the figure is referred to as a second heat exchanger core 1B.

The 1-1 chamber 111 of the first passage group G1 is provided with an inflow portion 104*a*, and the 1-2 chamber 112 is provided with a discharge portion 105*a*.

The internal passage 202 of the uppermost communication tube 201 (1-1 communication tube 211) of the four communication tubes 201 of the first passage group G1 in FIG. 12 is connected to the first fluid first header passage 4 of the first heat exchanger core 1A, and the internal passage 202 of the second communication tube 201 (1-2 communication tube 212) from the top is connected to the first fluid second header passage 5 of the first heat exchanger core 1A.

The internal passage 202 of the third communication tube 201 (1-3 communication tube 213) from the top is connected to the first fluid first header passage 4 of the second heat exchanger core 1B, and the internal passage 202 of the lowermost communication tube 201 (1-4 communication tube 214) is connected to the first fluid second header passage 5 of the second heat exchanger core 1B.

The 2-1 chamber 121 of the second passage group G2 is provided with an inflow portion 104*b*, and the 2-2 chamber 122 is provided with a discharge portion 105*b*.

The internal passage 202 of the uppermost communication tube 201 (2-1 communication tube 221) of the four communication tubes 201 of the second passage group in FIG. 12 is connected to the second fluid first header passage 6 of the first heat exchanger core 1A, and the internal passage 202 of the second communication tube 201 (2-2 communication tube 222) from the top is connected to the second fluid second header passage 7 of the first heat exchanger core 1A.

The internal passage 202 of the third communication tube 201 (2-3 communication tube 223) from the top is connected to the second fluid first header passage 6 of the second heat exchanger core 1B, and the internal passage 202 of the lowermost communication tube 201 (2-4 communication tube 224) is connected to the second fluid second header passage 7 of the second heat exchanger core 1B.

(Case of Parallel Connection and Countercurrent Flow)

With reference to FIGS. 13A and 13B, an example of passage switching when the first fluid and the second fluid are distributed in countercurrent flow to the first heat exchanger core 1A and the second heat exchanger core 1B that are connected in parallel will be described.

In this case, in the first passage group G1, for example, the internal passages 202 of the 1-2 communication tube 211 and the 1-4 communication tube 214 communicate with the 1-1 chamber 111, and the internal passages 202 of the 1-1 communication tube 211 and the 1-3 communication tube 213 communicate with the 1-2 chamber 112.

Further, in the second passage group G2, for example, the internal passages 202 of the 2-1 communication tube 221 and the 2-3 communication tube 223 communicate with the 2-1 chamber 121, and the internal passages 202 of the 2-2 communication tube 222 and the 2-4 communication tube 224 communicate with the 2-2 chamber 122.

As shown in FIG. 13A, the first fluid introduced from the outside through the inflow portion 104*a* to the 1-1 chamber 111 flows through the internal passage 202 of the 1-2 communication tube 212 and then the first fluid second header passage 5, the first passage 21, and the first fluid first header passage 4 in the first heat exchanger core 1A in this order. Then, the fluid flowing out of the first fluid first header passage 4 of the first heat exchanger core 1A flows through the internal passage 202 of the 1-1 communication tube 211 into the 1-2 chamber 112 and is then discharged from the 1-2 chamber 112 through the discharge portion 105*a* to the outside.

Similarly, the first fluid introduced from the outside through the inflow portion 104*a* to the 1-1 chamber 111 flows through the internal passage 202 of the 1-4 communication tube 214 and then the first fluid second header passage 5, the first passage 21, and the first fluid first header passage 4 in the second heat exchanger core 1B in this order. Then, the fluid flowing out of the first fluid first header passage 4 of the second heat exchanger core 1B flows through the internal passage 202 of the 1-3 communication tube 213 into the 1-2 chamber 112 and is then discharged from the 1-2 chamber 112 through the discharge portion 105*a* to the outside.

As shown in FIG. 13B, the second fluid introduced from the outside through the inflow portion 104*b* to the 2-1 chamber 121 flows through the internal passage 202 of the 2-1 communication tube 221 and then the second fluid first header passage 6, the second passage 22, and the second fluid second header passage 7 in the first heat exchanger core 1A in this order. Then, the fluid flowing out of the second fluid second header passage 7 flows through the internal passage 202 of the 2-2 communication tube 222 into the 2-2 chamber 122 and is then discharged from the 2-2 chamber 122 through the discharge portion 105*b* to the outside.

Similarly, the second fluid introduced from the outside through the inflow portion 104*b* to the 2-1 chamber 121 flows through the internal passage 202 of the 2-3 communication tube 223 and then the second fluid first header passage 6, the second passage 22, and the second fluid second header passage 7 in the second heat exchanger core 1B in this order. Then, the fluid flowing out of the second fluid second header passage 7 flows through the internal passage 202 of the 2-4 communication tube 224 into the 2-2 chamber 122 and is then discharged from the 2-2 chamber 122 through the discharge portion 105*b* to the outside.

(Case of Parallel Connection and Parallel Flow)

With reference to FIGS. 13A and 13C, an example of passage switching when the first fluid and the second fluid are distributed in parallel flow to the first heat exchanger core 1A and the second heat exchanger core 1B that are connected in parallel will be described.

In this case, in the first passage group G1, as in FIG. 13A described above, for example, the internal passages 202 of the 1-2 communication tube 211 and the 1-4 communication tube 214 communicate with the 1-1 chamber 111, and the internal passages 202 of the 1-1 communication tube 211 and the 1-3 communication tube 213 communicate with the 1-2 chamber 112.

Further, in the second passage group G2, for example, the internal passages 202 of the 2-2 communication tube 222 and the 2-4 communication tube 224 communicate with the 2-1 chamber 121, and the internal passages 202 of the 2-1 communication tube 221 and the 2-3 communication tube 223 communicate with the 2-2 chamber 122.

The first fluid introduced from the outside through the inflow portion 104*b* to the 1-1 chamber 111 flows inside the first heat exchanger core 1A and the second heat exchanger core 1B, as described with reference to FIG. 13A.

As shown in FIG. 13C, the second fluid introduced from the outside through the inflow portion 104*b* to the 2-1 chamber 121 flows through the internal passage 202 of the 2-2 communication tube 222 and then the second fluid second header passage 7, the second passage 22, and the second fluid first header passage 6 in the first heat exchanger core 1A in this order. Then, the fluid flowing out of the second fluid first header passage 6 flows through the internal passage 202 of the 2-1 communication tube 221 into the 2-2 chamber 122 and is then discharged from the 2-2 chamber 122 through the discharge portion 105*b* to the outside.

Similarly, the second fluid introduced from the outside through the inflow portion 104*b* to the 2-1 chamber 121 flows through the internal passage 202 of the 2-4 communication tube 224 and then the second fluid second header passage 7, the second passage 22, and the second fluid first header passage 6 in the second heat exchanger core 1B in this order. Then, the fluid flowing out of the second fluid first header passage 6 flows through the internal passage 202 of the 2-3 communication tube 223 into the 2-2 chamber 122 and is then discharged from the 2-2 chamber 122 through the discharge portion 105*b* to the outside.

(Case of Series Connection and Countercurrent Flow)

With reference to FIGS. 14A and 14B, an example of passage switching when the first fluid and the second fluid are distributed in countercurrent flow to the first heat exchanger core 1A and the second heat exchanger core 1B that are connected in series will be described.

In this case, in the first passage group G1, for example, the internal passage 202 of the 1-4 communication tube 214 communicates with the 1-1 chamber 111, the internal passage 202 of the 1-1 communication tube 211 communicates with the 1-2 chamber 112, and the internal passages 202 of the 1-2 communication tube 212 and the 1-3 communication tube 213 communicate with the 1-3 chamber 113.

Further, in the second passage group G2, for example, the internal passage 202 of the 2-1 communication tube 221 communicates with the 2-1 chamber 121, the internal passage 202 of the 2-4 communication tube 224 communicates with the 2-2 chamber 122, and the internal passages 202 of the 2-2 communication tube 222 and the 2-3 communication tube 223 communicate with the 2-3 chamber 123.

As shown in FIG. 14A, the first fluid introduced from the outside through the inflow portion 104*a* to the 1-1 chamber 111 flows through the internal passage 202 of the 1-4 communication tube 214 and then the first fluid second header passage 5, the first passage 21, and the first fluid first header passage 4 in the second heat exchanger core 1B in this order. Then, the fluid flowing out of the first fluid first header passage 4 of the second heat exchanger core 1B flows through the internal passage 202 of the 1-3 communication tube 213 into the 1-3 chamber 113.

The first fluid in the 1-3 chamber 113 flows through the internal passage 202 of the 1-2 communication tube 212 and then the first fluid second header passage 5, the first passage 21, and the first fluid first header passage 4 in the first heat exchanger core 1A in this order. Then, the fluid flowing out of the first fluid first header passage 4 of the first heat exchanger core 1A flows through the internal passage 202 of the 1-1 communication tube 211 into the 1-2 chamber 112 and is then discharged from the 1-2 chamber 112 through the discharge portion 105*a* to the outside.

As shown in FIG. 14B, the second fluid introduced from the outside through the inflow portion 104*b* to the 2-1 chamber 121 flows through the internal passage 202 of the 2-1 communication tube 221 and then the second fluid first header passage 6, the second passage 22, and the second fluid second header passage 7 in the first heat exchanger core 1A in this order. Then, the fluid flowing out of the second fluid second header passage 7 flows through the internal passage 202 of the 2-2 communication tube 222 into the 2-3 chamber 122.

The second fluid in the 2-3 chamber 122 flows through the internal passage 202 of the 2-3 communication tube 223 and then the second fluid first header passage 6, the second passage 22, and the second fluid second header passage 7 in the second heat exchanger core 1B in this order. Then, the fluid flowing out of the second fluid second header passage 7 flows through the internal passage 202 of the 2-4 communication tube 224 into the 2-2 chamber 122 and is then discharged from the 2-2 chamber 122 through the discharge portion 105*b* to the outside.

(Case of Series Connection and Parallel Flow)

With reference to FIGS. 14A and 14C, an example of passage switching when the first fluid and the second fluid are distributed in parallel flow to the first heat exchanger core 1A and the second heat exchanger core 1B that are connected in series will be described.

In this case, in the first passage group G1, for example, as in FIG. 14A described above, for example, the internal passage 202 of the 1-4 communication tube 214 communicates with the 1-1 chamber 111, the internal passage 202 of the 1-1 communication tube 211 communicates with the 1-2 chamber 112, and the internal passages 202 of the 1-2 communication tube 212 and the 1-3 communication tube 213 communicate with the 1-3 chamber 113.

Further, in the second passage group G2, for example, the internal passage 202 of the 2-4 communication tube 224 communicates with the 2-1 chamber 121, the internal passage 202 of the 2-1 communication tube 221 communicates with the 2-2 chamber 122, and the internal passages 202 of the 2-2 communication tube 222 and the 2-3 communication tube 223 communicate with the 2-3 chamber 123.

The first fluid introduced from the outside through the inflow portion 104*b* to the 1-1 chamber 111 flows inside the first heat exchanger core 1A and the second heat exchanger core 1B, as described with reference to FIG. 14A.

As shown in FIG. 14C, the second fluid introduced from the outside through the inflow portion 104*b* to the 2-1 chamber 121 flows through the internal passage 202 of the 2-4 communication tube 224 and then the second fluid second header passage 7, the second passage 22, and the second fluid first header passage 6 in the second heat exchanger core 1B in this order. Then, the fluid flowing out of the second fluid first header passage 6 flows through the internal passage 202 of the 2-3 communication tube 223 into the 2-3 chamber 123.

The second fluid in the 2-3 chamber 123 flows through the internal passage 202 of the 2-2 communication tube 222 and then the second fluid second header passage 7, the second passage 22, and the second fluid first header passage 6 in the first heat exchanger core 1A in this order. Then, the fluid flowing out of the second fluid first header passage 6 flows through the internal passage 202 of the 2-1 communication tube 221 into the 2-2 chamber 122 and is then discharged from the 2-2 chamber 122 through the discharge portion 105*b* to the outside.

In the embodiment shown in FIG. 12, six chambers 101 are stacked along the axial direction AX, but three chambers 101 of the six chambers 101 may constitute a first switching unit 151 for switching the flow of the first fluid, and the other three chambers 101 may constitute a second switching unit 152 for switching the flow of the second fluid.

Figure 15:
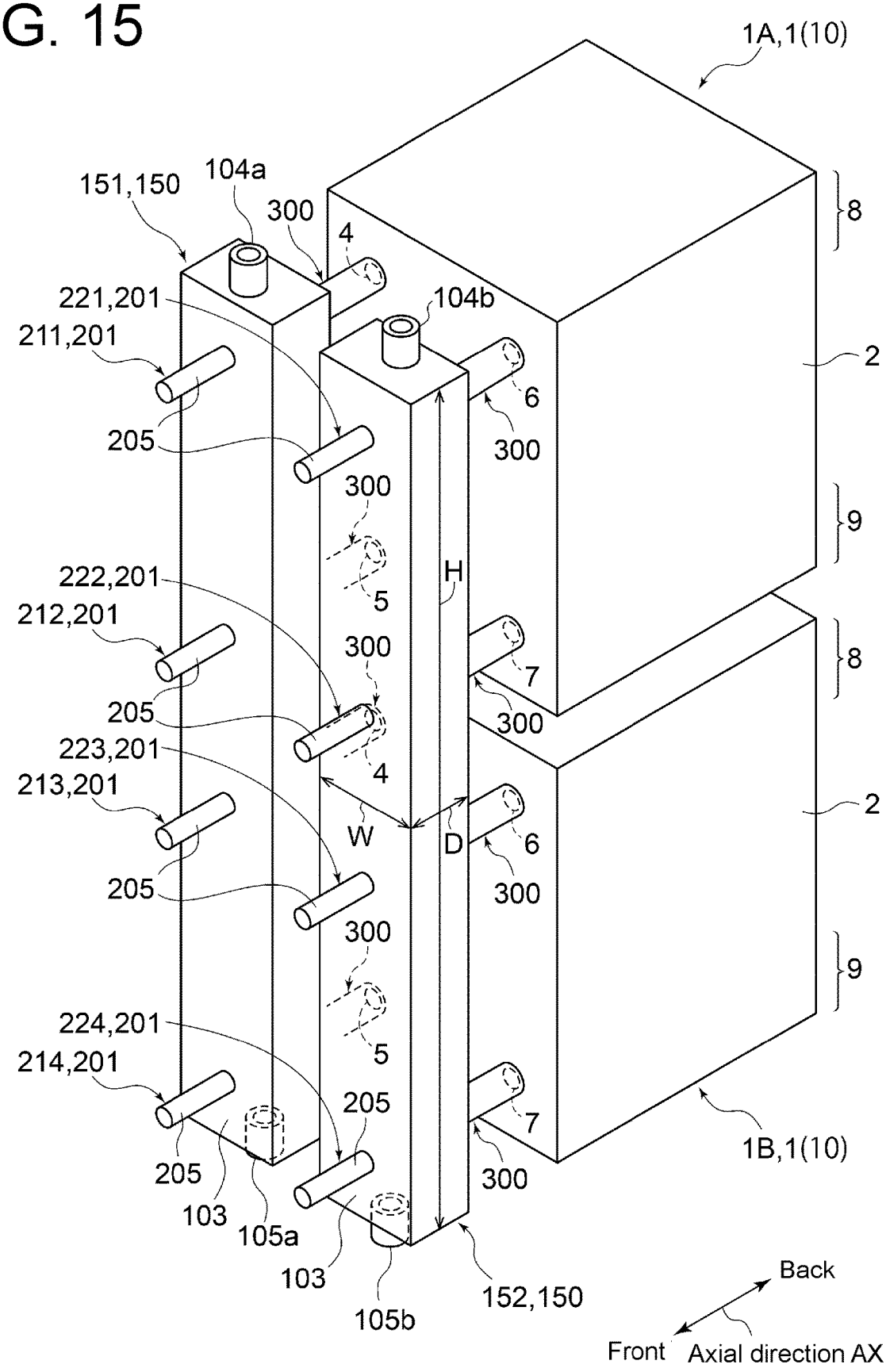
FIG. 15 is a perspective view of a schematic appearance of a heat exchanger passage switching device having a first switching unit and a second switching unit.

FIG. 15 is a perspective view of a schematic appearance of a heat exchanger passage switching device 150 having a first switching unit and a second switching unit.

The first switching unit 151 and the second switching unit 152 may be arranged at positions that do not overlap each other when viewed from the axial direction AX.

For example, the first switching unit 151 may have a configuration corresponding to the first passage group G1 of the heat exchanger passage switching device 150 shown in FIG. 12. Further, the second switching unit 152 may have a configuration corresponding to the second passage group G2 of the heat exchanger passage switching device 150 shown in FIG. 12. Thereby, as with the heat exchanger passage switching device 150 shown in FIG. 12, in the two heat exchanger cores 1, the first fluid and the second fluid can be circulated in parallel connection and countercurrent flow, in parallel connection and parallel flow, in series connection and countercurrent flow, and in series connection and parallel flow.

In the heat exchanger passage switching device 150 according to some embodiments, as shown in FIG. 15, the dimension D of the heat exchanger passage switching device 150 in the axial direction AX is smaller than the dimensions W, F in the directions perpendicular to the axial direction AX. In the heat exchanger passage switching device 150 shown in FIG. 15, multiple chambers 101 are stacked along the axial direction AX. Therefore, the dimension d of each chamber 101 in the axial direction AX is smaller than the dimension D of the heat exchanger passage switching device 150 shown in FIG. 15 in the axial direction AX. Therefore, the dimension d of each chamber 101 in the axial direction AX is smaller than the dimensions W, F in the directions perpendicular to the axial direction AX.

(Heat Insulation Between Adjacent Chambers 101)

Figure 16:
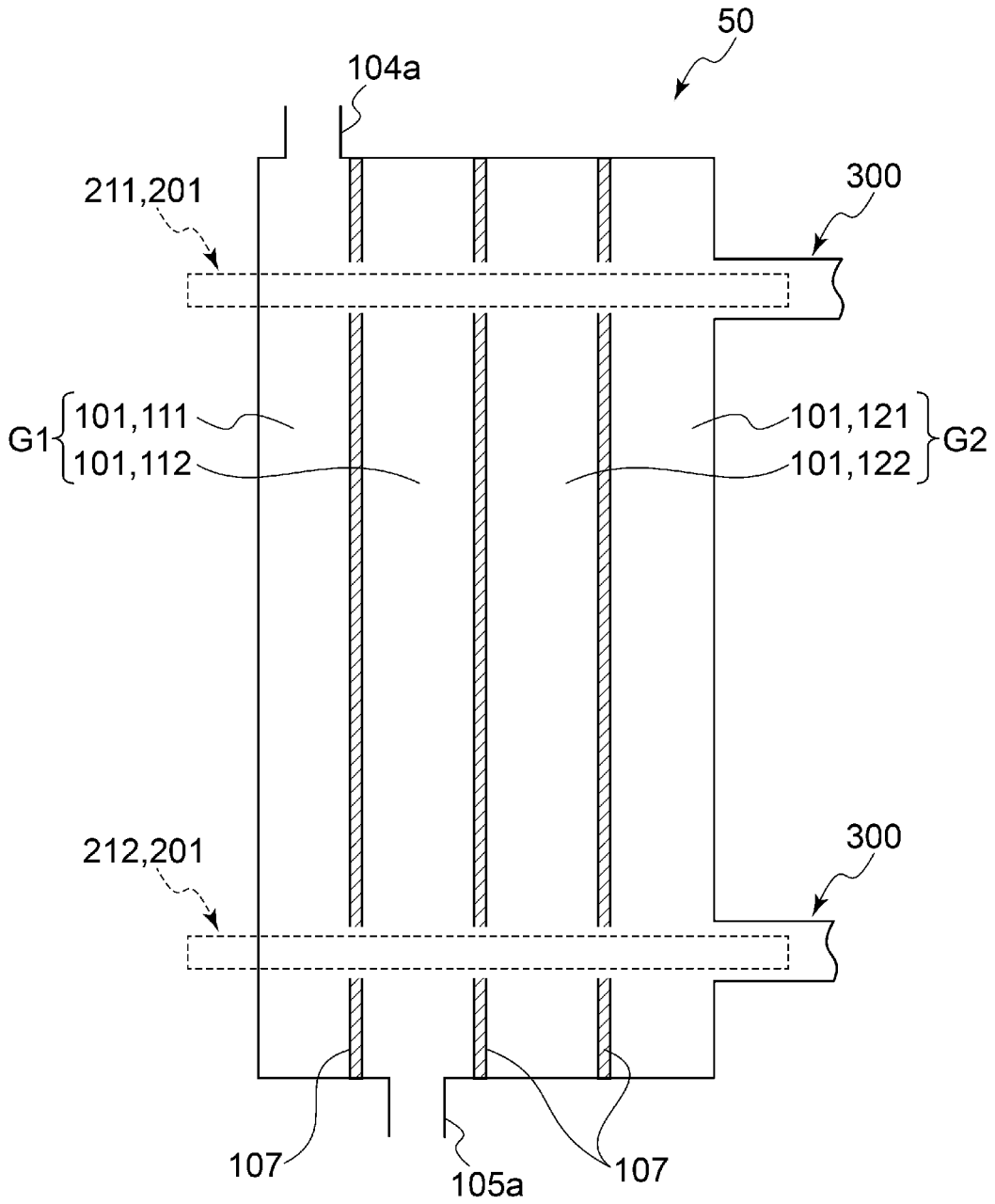
FIG. 16 is a schematic cross-sectional view for describing a heat insulation layer disposed between adjacent chambers.

FIG. 16 is a schematic cross-sectional view for describing a heat insulation layer disposed between adjacent chambers.

In the heat exchanger passage switching device 50, 150 according to some embodiments, the fluids flowing through the chambers 101 adjacent in the axial direction AX have different temperatures. Therefore, for example, as shown in FIG. 16, a heat insulation layer 107 may be provided between the chambers 101 adjacent along the axial direction AX.

In the case where the same fluid flows through two adjacent chambers 101, the temperature of the fluid raised (or lowered) by heat exchange in the heat exchanger core 1 may be lowered (raised) due to heat exchange between the two adjacent chambers 101, which may decrease the heat exchange efficiency.

In view of this, in the heat exchanger passage switching device 50, 150 according to some embodiments, the heat insulation layer 107 may be provided at least between the chambers 101 through which the same fluid flows, among the chambers 101 adjacent in the axial direction AX.

The present disclosure is not limited to the embodiments described above, but includes modifications to the embodiments described above, and embodiments composed of combinations of those embodiments.

The contents described in the above embodiments would be understood as follows, for instance.

(1) A heat exchanger passage switching device 50, 150 according to at least one embodiment of the present disclosure includes: a communication tube 201 having an internal passage 202 communicating with a heat exchange passage for performing heat exchange inside a heat exchanger 10, and one or more communication holes 203 communicating with the internal passage 202; and at least one chamber 101 having an insertion hole 102 into which the communication tube 201 is inserted to slidably support the communication tube 201 inserted in the insertion hole 102. The communication tube 201 is capable of switching a communication state between the communication hole 203 and the chamber 101 by a relative position of the communication tube 201 to the chamber 101 in the axial direction AX.

With the above configuration (1), it is possible to switch the communication state between the heat exchange passage (first passage 21 and second passage 22) inside the heat exchanger 10 and the chamber 101 outside the heat exchanger 10 with a simple configuration.

(2) In some embodiments, in the above configuration (1), the at least one chamber 101 has at least one fixed tube 300 which is fixed to each chamber 101 and inside which the insertion hole 102 is formed. The at least one fixed tube 300 has a through hole 305 formed corresponding to each chamber 101 and penetrating a tube wall 301 of the fixed tube 300 to allow communication between the insertion hole 102 and each chamber 101. When the communication tube 201 is moved to a relative position where any through hole 305 overlaps the one or more communication holes 203, the communication tube 201 allows communication between the internal passage 202 and the chamber 101 corresponding to the through hole 305 that overlaps the one or more communication holes 203, and blocks communication between the internal passage 202 and the chamber 101 corresponding to the through hole 305 that does not overlap the one or more communication holes 203.

With the above configuration (2), since the communication state between the internal passage 202 of the communication tube 201 and the chamber 101 can be switched based on whether one or more communication holes 203 of the communication tube 201 overlap the through hole 305 formed in the fixed tube 300, it is possible to switch the communication state between the heat exchange passage (first passage 21 and second passage 22) inside the heat exchanger 10 and the chamber 101 outside the heat exchanger 10 with a simple configuration. Further, when the fixed tube 300 is connected to the heat exchange passage (first passage 21 and second passage 22) of the heat exchanger 10 subject to passage switching, since it is not necessary to change the relative position between the chamber 101 and the heat exchanger 10, the device configuration can be simplified.

(3) In some embodiments, in the above configuration (1) or (2), the switching device includes at least two communication tubes 201. The at least one chamber 101 includes at least two chambers 10 stacked along the axial direction AX. The at least two chambers 101 have at least two insertion holes 102 into which the at least two communication tubes 201 are inserted, respectively Each of the at least two communication tubes 201 is configured to select which one of the at least two chambers 101 to be communicated with the communication hole 203 by the relative position to the chamber 101.

In the above configuration (3), attention is paid to the two communication tubes 201 and the two chambers 101.

It is assumed that a fluid is introduced from the outside to one of the two chambers 101, and the fluid is discharged from the other chamber 101 to the outside. Further, the internal passage 202 of one of the two communication tubes 201 is connected to one end of the heat exchange passage of the heat exchanger 10 subject to passage switching, and the internal passage 202 of the other communication tube 201 is connected to the other end of the heat exchange passage of the heat exchanger 10.

In such a case, the flow of fluid when the internal passage 202 of one communication tube 201 communicates with one chamber 101, and the internal passage 202 of the other communication tube 201 communicates with the other chamber 101 is as follows.

The fluid introduced from the outside to one chamber 101 flows through the internal passage 202 of one communication tube 201 and then flows from one end to the other end of the heat exchange passage of the heat exchanger 10. Then, the fluid flowing out of the other end of the heat exchange passage flows through the internal passage 202 of the other communication tube 201 into the other chamber 101 and is then discharged from the other chamber 101 to the outside.

Further, the flow of fluid when the internal passage 202 of one communication tube 201 communicates with the other chamber 101, and the internal passage 202 of the other communication tube 201 communicates with one chamber 101 is as follows.

The fluid introduced from the outside to one chamber 101 flows through the internal passage 202 of the other communication tube 201 and then flows from the other end to one end of the heat exchange passage of the heat exchanger 10. Then, the fluid flowing out of one end of the heat exchange passage flows through the internal passage 202 of one communication tube 201 into the other chamber 101 and is then discharged from the other chamber 101 to the outside.

Thus, with the above configuration (3), by changing the relative position of the communication tube 201 to the chamber 101 in the axial direction AX, the flow of fluid in the heat exchange passage can be reversed without changing the chamber 101 to which the fluid is introduced from the outside and the chamber 101 from which the fluid is discharged to the outside.

(4) In some embodiments, in any one of the above configurations (1) to (3), the switching device includes at least four communication tubes 201. The at least one chamber 101 includes at least four chambers 10 stacked along the axial direction AX. The at least four chambers 101 have at least four insertion holes 102 into which the at least four communication tubes 201 are inserted, respectively Each of the at least four communication tubes 201 is configured to select which one of the at least four chambers 101 to be communicated with the communication hole 203 by the relative position to the chamber 101.

In the above configuration (4), attention is paid to the four communication tubes 201 and the four chambers 101. The fluid flow will be discussed separately for a first passage group G1 including two communication tubes 201 and two chambers 101 of the four communication tubes 201 and four chambers 101, and a second passage group G2 including the other two communication tubes 201 and two chambers 101.

It is assumed that the first fluid is introduced from the outside to one chamber 101 (1-1 chamber 111) of the two chambers 101 of the first passage group G1, and the fluid is discharged from the other chamber 101 (1-2 chamber 112) to the outside. Further, the internal passage 202 of one communication tube 201 (1-1 communication tube 211) of the two communication tubes 201 of the first passage group G1 is connected to one end of the first heat exchange passage (e.g., first passage 21) of the heat exchanger 10 subject to passage switching, and the internal passage 202 of the other communication tube 201 (1-2 communication tube 212) is connected to the other end of the first heat exchange passage of the heat exchanger 10.

It is assumed that the second fluid is introduced from the outside to one chamber 101 (2-1 chamber 121) of the two chambers 101 of the second passage group G2, and the fluid is discharged from the other chamber 101 (2-2 chamber 122) to the outside. Further, the internal passage 202 of one communication tube 201 (2-1 communication tube 221) of the two communication tubes 201 of the second passage group G2 is connected to one end of the second heat exchange passage (e.g., second passage 22) of the heat exchanger 10 subject to passage switching, and the internal passage 202 of the other communication tube 201 (2-2 communication tube 222) is connected to the other end of the second heat exchange passage of the heat exchanger 10.

The heat exchanger 10 subject to passage switching is configured to be able to exchange heat between the fluid flowing through the first heat exchange passage and the fluid flowing through the second heat exchange passage.

In such a case, the flow of fluid when the internal passage 202 of the 1-1 communication tube 211 of the first passage group G1 communicates with the 1-1 chamber 111, and the internal passage 202 of the 1-2 communication tube 212 communicates with the 1-2 chamber 112 is as follows.

The first fluid introduced from the outside to the 1-1 chamber 111 flows through the internal passage 202 of the 1-1 communication tube 211 and then flows from one end to the other end of the first heat exchange passage of the heat exchanger 10. Then, the fluid flowing out of the other end of the first heat exchange passage flows through the internal passage 202 of the 1-2 communication tube 212 into the 1-2 chamber 112 and is then discharged from the 1-2 chamber 112 to the outside.

Further, the flow of fluid when the internal passage 202 of the 1-1 communication tube 211 communicates with the 1-2 chamber 112, and the internal passage 202 of the 1-2 communication tube 212 communicates with the 1-1 chamber 111 is as follows.

The first fluid introduced from the outside to the 1-1 chamber 111 flows through the internal passage 202 of the 1-2 communication tube 212 and then flows from the other end to one end of the first heat exchange passage of the heat exchanger 10. Then, the fluid flowing out of one end of the first heat exchange passage flows through the internal passage 202 of the 1-1 communication tube 211 into the 1-2 chamber 112 and is then discharged from the 1-2 chamber 112 to the outside.

Thus, with the above configuration (4), by changing the relative position of the communication tube 201 to the chamber 101 in the axial direction AX, the flow of the first fluid in the first heat exchange passage can be reversed without changing the 1-1 chamber 111 to which the first fluid is introduced from the outside and the 1-2 chamber 112 from which the fluid is discharged to the outside.

The flow of fluid when the internal passage 202 of the 2-1 communication tube 221 of the second passage group G2 communicates with the 2-1 chamber 121, and the internal passage 202 of the 2-2 communication tube 222 communicates with the 2-2 chamber 122 is as follows.

The second fluid introduced from the outside to the 2-1 chamber 121 flows through the internal passage 202 of the 2-1 communication tube 221 and then flows from one end to the other end of the second heat exchange passage of the heat exchanger 10. Then, the fluid flowing out of the other end of the second heat exchange passage flows through the internal passage 202 of the 2-2 communication tube 222 into the 2-2 chamber 122 and is then discharged from the 2-2 chamber 122 to the outside.

The flow of fluid when the internal passage 202 of the 2-1 communication tube 221 communicates with the 2-2 chamber 122, and the internal passage 202 of the 2-2 communication tube 222 communicates with the 2-1 chamber 121 is as follows.

The second fluid introduced from the outside to the 2-1 chamber 121 flows through the internal passage 202 of the 2-2 communication tube 222 and then flows from the other end to one end of the second heat exchange passage of the heat exchanger 10. Then, the fluid flowing out of one end of the second heat exchange passage flows through the internal passage 202 of the 2-1 communication tube 221 into the 2-2 chamber 122 and is then discharged from the 2-2 chamber 122 to the outside.

Thus, with the above configuration (4), by changing the relative position of the communication tube 201 to the chamber 101 in the axial direction AX, the flow of the second fluid in the second heat exchange passage can be reversed without changing the 2-1 chamber 121 to which the second fluid is introduced from the outside and the 2-2 chamber 122 from which the fluid is discharged to the outside.

Further, in the above configuration (4), by switching the communication state between the 1-1 chamber 111 and the 1-2 chamber 112 of the first passage group G1 and the 2-1 communication tube 221 and the 2-2 communication tube 222 of the second passage group G2, the first fluid can be circulated through the second heat exchange passage, and the flow of the first fluid in the second heat exchange passage can be reversed, without changing the 1-1 chamber 111 to which the first fluid is introduced from the outside and the 1-2 chamber 112 from which the fluid is discharged to the outside.

Similarly, in the above configuration (4), by switching the communication state between the 2-1 chamber 121 and the 2-2 chamber 122 of the second passage group G2 and the 1-1 communication tube 211 and the 1-2 communication tube 212 of the first passage group G1, the second fluid can be circulated through the first heat exchange passage, and the flow of the second fluid in the first heat exchange passage can be reversed, without changing the 2-1 chamber 121 to which the second fluid is introduced from the outside and the 2-2 chamber 122 from which the fluid is discharged to the outside.

(5) In some embodiments, in any one of the above configurations (1) to (3), the switching device includes a first switching unit 51 and a second switching unit 52 each of which includes at least two communication tubes 201 and at least two chambers 101 stacked along the axial direction AX. The first switching unit 51 and the second switching unit 52 are arranged at positions that do not overlap each other when viewed from the axial direction AX.

In each of the first switching unit 51 and the second switching unit 52, the at least two chambers 101 have at least two insertion holes 102 into which the at least two communication tubes 201 are inserted, respectively.

In each of the first switching unit 51 and the second switching unit 52, each of the at least two communication tubes 201 is configured to select which one of the at least two chambers 101 to be communicated with the communication hole 203 by the relative position of the communication tube 201 to the chamber 101.

In the above configuration (5), attention is paid to the two communication tubes 201 and the two chambers 101 of each of the first switching unit 51 and the second switching unit 52.

It is assumed that the first fluid is introduced from the outside to one chamber 101 (1-1 chamber 111) of the two chambers 101 of the first switching unit 51, and the fluid is discharged from the other chamber 101 (1-2 chamber 112) to the outside. Further, the internal passage 202 of one communication tube 201 (1-1 communication tube 211) of the two communication tubes 201 of the first switching unit 51 is connected to one end of the first heat exchange passage (e.g., first passage 21) of the heat exchanger 10 subject to passage switching, and the internal passage 202 of the other communication tube 201 (1-2 communication tube 212) is connected to the other end of the first heat exchange passage of the heat exchanger 10.

It is assumed that the second fluid is introduced from the outside to one chamber 101 (2-1 chamber 121) of the two chambers 101 of the second switching unit 52, and the fluid is discharged from the other chamber 101 (2-2 chamber 122) to the outside. Further, the internal passage 202 of one communication tube 201 (2-1 communication tube 221) of the two communication tubes 201 of the second switching unit 52 is connected to one end of the second heat exchange passage (e.g., second passage 22) of the heat exchanger 10 subject to passage switching, and the internal passage 202 of the other communication tube 201 (2-2 communication tube 222) is connected to the other end of the second heat exchange passage of the heat exchanger 10.

The heat exchanger 10 subject to passage switching is configured to be able to exchange heat between the fluid flowing through the first heat exchange passage and the fluid flowing through the second heat exchange passage.

In such a case, the flow of fluid when the internal passage 202 of the 1-1 communication tube 211 of the first switching unit 51 communicates with the 1-1 chamber 111, and the internal passage 202 of the 1-2 communication tube 212 communicates with the 1-2 chamber 112 is as follows.

The first fluid introduced from the outside to the 1-1 chamber 111 flows through the internal passage 202 of the 1-1 communication tube 211 and then flows from one end to the other end of the first heat exchange passage of the heat exchanger 10. Then, the fluid flowing out of the other end of the first heat exchange passage flows through the internal passage 202 of the 1-2 communication tube 212 into the 1-2 chamber 112 and is then discharged from the 1-2 chamber 112 to the outside.

Further, the flow of fluid when the internal passage 202 of the 1-1 communication tube 211 communicates with the 1-2 chamber 112, and the internal passage 202 of the 1-2 communication tube 212 communicates with the 1-1 chamber 111 is as follows.

The first fluid introduced from the outside to the 1-1 chamber 111 flows through the internal passage 202 of the 1-2 communication tube 212 and then flows from the other end to one end of the first heat exchange passage of the heat exchanger 10. Then, the fluid flowing out of one end of the first heat exchange passage flows through the internal passage 202 of the 1-1 communication tube 211 into the 1-2 chamber 112 and is then discharged from the 1-2 chamber 112 to the outside.

Thus, with the above configuration (5), by changing the relative position of the communication tube 201 to the chamber 101 in the axial direction AX, the flow of the first fluid in the first heat exchange passage can be reversed without changing the 1-1 chamber 111 to which the first fluid is introduced from the outside and the 1-2 chamber 112 from which the fluid is discharged to the outside.

The flow of fluid when the internal passage 202 of the 2-1 communication tube 221 of the second switching unit 52 communicates with the 2-1 chamber 121, and the internal passage 202 of the 2-2 communication tube 222 communicates with the 2-2 chamber 122 is as follows.

The second fluid introduced from the outside to the 2-1 chamber 121 flows through the internal passage 202 of the 2-1 communication tube 221 and then flows from one end to the other end of the second heat exchange passage of the heat exchanger 10. Then, the fluid flowing out of the other end of the second heat exchange passage flows through the internal passage 202 of the 2-2 communication tube 222 into the 2-2 chamber 122 and is then discharged from the 2-2 chamber 122 to the outside.

The flow of fluid when the internal passage 202 of the 2-1 communication tube 221 communicates with the 2-2 chamber 122, and the internal passage 202 of the 2-2 communication tube 222 communicates with the 2-1 chamber 121 is as follows.

The second fluid introduced from the outside to the 2-1 chamber 121 flows through the internal passage 202 of the 2-2 communication tube 222 and then flows from the other end to one end of the second heat exchange passage of the heat exchanger 10. Then, the fluid flowing out of one end of the second heat exchange passage flows through the internal passage 202 of the 2-1 communication tube 221 into the 2-2 chamber 122 and is then discharged from the 2-2 chamber 122 to the outside.

Thus, with the above configuration (5), by changing the relative position of the communication tube 201 to the chamber 101 in the axial direction AX, the flow of the second fluid in the second heat exchange passage can be reversed without changing the 2-1 chamber 121 to which the second fluid is introduced from the outside and the 2-2 chamber 122 from which the fluid is discharged to the outside.

Further, with the above configuration (5), since the first switching unit 51 and the second switching unit 52 are arranged at positions that do not overlap each other when viewed from the axial direction AX, the dimension of the heat exchanger passage switching device 50, 150 along the axial direction AX can be reduced.

(6) In some embodiments, in any one of the above configurations (1) to (3), the switching device includes at least eight communication tubes 201. The at least one chamber 101 includes at least six chambers 10 stacked along the axial direction AX. The at least six chambers 101 have at least eight insertion holes 102 into which the at least eight communication tubes 201 are inserted, respectively Each of the at least eight communication tubes 201 is configured to select which one of the at least six chambers 101 to be communicated with the communication hole 203 by the relative position to the chamber 101.

In the above configuration (6), attention is paid to the eight communication tubes 201 and the six chambers 101. The fluid flow will be discussed separately for a first passage group G1 including four communication tubes 201 and three chambers 101 of the eight communication tubes 201 and six chambers 101, and a second passage group G2 including the other four communication tubes 201 and three chambers 101.

It is assumed that the first fluid is introduced from the outside to one chamber 101 (1-1 chamber 111) of the three chambers 101 of the first passage group G1, and the fluid is discharged from another chamber 101 (1-2 chamber 112) to the outside.

Further, the internal passage 202 of one communication tube 201 (1-1 communication tube 211) of the four communication tubes 201 of the first passage group G1 is connected to one end of the first heat exchange passage (e.g., first passage 21) of the first heat exchanger (e.g., first heat exchanger core 1A) subject to passage switching, and the internal passage 202 of another communication tube 201 (1-2 communication tube 212) is connected to the other end of the first heat exchange passage of the first heat exchanger.

Further, the internal passage 202 of still another communication tube 201 (1-3 communication tube 213) of the four communication tubes 201 of the first passage group G1 is connected to one end of the first heat exchange passage (e.g., first passage 21) of the second heat exchanger (e.g., second heat exchanger core 1B) subject to passage switching, and the internal passage 202 of the remaining one communication tube 201 (1-4 communication tube 214) is connected to the other end of the first heat exchange passage of the second heat exchanger.

Similarly, it is assumed that the second fluid is introduced from the outside to one chamber 101 (2-1 chamber 121) of the three chambers 101 of the second passage group G2, and the fluid is discharged from another chamber 101 (2-2 chamber 122) to the outside.

Further, the internal passage 202 of one communication tube 201 (2-1 communication tube 221) of the four communication tubes 201 of the second passage group G2 is connected to one end of the second heat exchange passage (e.g., second passage 22) of the first heat exchanger (e.g., first heat exchanger core 1A) subject to passage switching, and the internal passage 202 of another communication tube 201 (2-2 communication tube 222) is connected to the other end of the second heat exchange passage (e.g., second passage 22) of the first heat exchanger.

Further, the internal passage 202 of still another communication tube 201 (2-3 communication tube 223) of the four communication tubes 201 of the second passage group G2 is connected to one end of the second heat exchange passage (e.g., second passage 22) of the second heat exchanger (e.g., second heat exchanger core 1B) subject to passage switching, and the internal passage 202 of the remaining one communication tube 201 (2-4 communication tube 224) is connected to the other end of the second heat exchange passage of the second heat exchanger.

The first heat exchanger and the second heat exchanger subject to passage switching are configured to be able to exchange heat between the fluid flowing through the first heat exchange passage and the fluid flowing through the second heat exchange passage.

With the above configuration (6), by changing the relative position of the communication tube 201 to the chamber 101 in the axial direction AX, the flow of the first fluid in the first heat exchange passage of the first heat exchanger can be reversed, and the flow of the first fluid in the first heat exchange passage of the second heat exchanger can be reversed, without changing the 1-1 chamber 111 to which the first fluid is introduced from the outside and the 1-2 chamber 112 from which the fluid is discharged to the outside. Further, the first heat exchange passage of the first heat exchanger and the first heat exchange passage of the second heat exchanger can be connected in series and can be connected in parallel.

With the above configuration (6), by changing the relative position of the communication tube 201 to the chamber 101 in the axial direction AX, the flow of the second fluid in the second heat exchange passage of the first heat exchanger can be reversed, and the flow of the second fluid in the second heat exchange passage of the second heat exchanger can be reversed, without changing the 2-1 chamber 121 to which the second fluid is introduced from the outside and the 2-2 chamber 122 from which the fluid is discharged to the outside. Further, the second heat exchange passage of the first heat exchanger and the second heat exchange passage of the second heat exchanger can be connected in series and can be connected in parallel.

Further, with the above configuration (6), the first fluid can be circulated through the second heat exchange passage of the first heat exchanger, and the flow of the first fluid in the second heat exchange passage of the first heat exchanger can be reversed.

With the above configuration (6), the second fluid can be circulated through the first heat exchange passage of the first heat exchanger, and the flow of the second fluid in the first heat exchange passage of the first heat exchanger can be reversed.

With the above configuration (6), the first fluid can be circulated through the second heat exchange passage of the second heat exchanger, and the flow of the first fluid in the second heat exchange passage of the second heat exchanger can be reversed.

With the above configuration (6), the second fluid can be circulated through the first heat exchange passage of the second heat exchanger, and the flow of the second fluid in the first heat exchange passage of the second heat exchanger can be reversed.

(7) In some embodiments, in any one of the above configurations (1) to (3), the switching device includes a first switching unit 151 and a second switching unit 152 each of which includes at least four communication tubes 201 and at least three chambers 101 stacked along the axial direction AX. The first switching unit 151 and the second switching unit 152 are arranged at positions that do not overlap each other when viewed from the axial direction AX.

In each of the first switching unit and the second switching unit, the at least three chambers 101 have at least four insertion holes 102 into which the at least four communication tubes 201 are inserted, respectively.

In each of the first switching unit 151 and the second switching unit 152, each of the at least four communication tubes 201 is configured to select which one of the at least three chambers 101 to be communicated with the communication hole 203 by the relative position to the chamber 101.

In the above configuration (7), attention is paid to the four communication tubes 201 and the three chambers 101 of each of the first switching unit 151 and the second switching unit 152.

It is assumed that the first fluid is introduced from the outside to one chamber 101 (1-1 chamber 111) of the three chambers 101 of the first switching unit 151, and the fluid is discharged from another chamber 101 (1-2 chamber 112) to the outside.

Further, the internal passage 202 of one communication tube 201 (1-1 communication tube 211) of the four communication tubes 201 of the first switching unit 151 is connected to one end of the first heat exchange passage (e.g., first passage 21) of the first heat exchanger (e.g., first heat exchanger core 1A) subject to passage switching, and the internal passage 202 of another communication tube 201 (1-2 communication tube 212) is connected to the other end of the first heat exchange passage of the first heat exchanger.

Further, the internal passage 202 of still another communication tube 201 (1-3 communication tube 213) of the four communication tubes 201 of the first switching unit is connected to one end of the first heat exchange passage (e.g., first passage 21) of the second heat exchanger (e.g., second heat exchanger core 1B) subject to passage switching, and the internal passage 202 of the remaining one communication tube 201 (1-4 communication tube 214) is connected to the other end of the first heat exchange passage of the second heat exchanger.

Similarly, it is assumed that the second fluid is introduced from the outside to one chamber 101 (2-1 chamber 121) of the three chambers 101 of the second switching unit, and the fluid is discharged from another chamber 101 (2-2 chamber 122) to the outside.

Further, the internal passage 202 of one communication tube 201 (2-1 communication tube 221) of the four communication tubes 201 of the second switching unit is connected to one end of the second heat exchange passage (e.g., second passage 22) of the first heat exchanger (e.g., first heat exchanger core 1A) subject to passage switching, and the internal passage 202 of another communication tube 201 (2-2 communication tube 222) is connected to the other end of the second heat exchange passage of the first heat exchanger.

Further, the internal passage 202 of still another communication tube 201 (2-3 communication tube 223) of the four communication tubes 201 of the second switching unit is connected to one end of the second heat exchange passage (e.g., second passage 22) of the second heat exchanger (e.g., second heat exchanger core 1B) subject to passage switching, and the internal passage 202 of the remaining one communication tube 201 (1-4 communication tube 224) is connected to the other end of the second heat exchange passage of the second heat exchanger.

The first heat exchanger and the second heat exchanger subject to passage switching are configured to be able to exchange heat between the fluid flowing through the first heat exchange passage and the fluid flowing through the second heat exchange passage.

With the above configuration (7), by changing the relative position of the communication tube 201 to the chamber 101 in the axial direction AX, the flow of the first fluid in the first heat exchange passage of the first heat exchanger can be reversed, and the flow of the first fluid in the first heat exchange passage of the second heat exchanger can be reversed, without changing the 1-1 chamber 111 to which the first fluid is introduced from the outside and the 1-2 chamber 112 from which the fluid is discharged to the outside. Further, the first heat exchange passage of the first heat exchanger and the first heat exchange passage of the second heat exchanger can be connected in series and can be connected in parallel.

With the above configuration (7), by changing the relative position of the communication tube 201 to the chamber 101 in the axial direction AX, the flow of the second fluid in the second heat exchange passage of the first heat exchanger can be reversed, and the flow of the second fluid in the second heat exchange passage of the second heat exchanger can be reversed, without changing the 2-1 chamber 121 to which the second fluid is introduced from the outside and the 2-2 chamber 122 from which the fluid is discharged to the outside. Further, the second heat exchange passage of the first heat exchanger and the second heat exchange passage of the second heat exchanger can be connected in series and can be connected in parallel.

Further, with the above configuration (7), since the first switching unit 151 and the second switching unit 152 are arranged at positions that do not overlap each other when viewed from the axial direction AX, the dimension of the heat exchanger passage switching device 150 along the axial direction AX can be reduced.

(8) In some embodiments, in any one of the above configurations (3) to (7), at least two chambers 101 have inflow portions 104*a*, 104*b* and discharge portions 105*a*, 105*b* as openings that allow a fluid to flow between the inside and outside of the chambers 101 regardless of the relative position of the communication tube 201.

With the above configuration (8), since the fluid can be introduced from the outside to one chamber 101 of the at least two chambers 101, the fluid supplied from the outside to the heat exchanger passage switching device 50, 150 can be supplied to the heat exchange passage of the heat exchanger 10 subject to passage switching. Further, with the above configuration (8), since the fluid can be discharged from another chamber 101 of the at least two chambers 101 to the outside, the fluid flowing from the heat exchange passage of the heat exchanger 10 can be discharged to the outside of the heat exchanger passage switching device 50, 150.

(9) In some embodiments, in any one of the above configurations (3) to (8), a heat insulation layer 107 is disposed between the chambers 101 that are adjacent to each other along the axial direction AX.

With the above configuration (9), it is possible to suppress undesired heat transfer between the chambers 101 adjacent along the axial direction AX and suppress a decrease in heat exchange efficiency.

(10) In some embodiments, in any one of the above configurations (1) to (9), the dimension d of the at least one chamber 101 in the axial direction AX is smaller than the dimension W, H in a direction perpendicular to the axial direction AX.

In the heat exchanger subject to passage switching, such as the heat exchanger core 1 (heat exchanger 10) according to the above-described embodiments and the plate heat exchanger, one end and the other end of the heat exchange passage may be relatively apart from each other due to the structure. Even in such a case, with the above configuration (10), for example, even if two or more communication tubes 201 are separated in a direction intersecting the axial direction AX of the communication tubes 201, the dimension of the heat exchanger passage switching device 50, 150 in the axial direction AX can be reduced.

REFERENCE SIGNS LIST

1 Heat exchanger core
2 Body part
10 Heat exchanger
21 First passage
22 Second passage
50, 150 Heat exchanger passage switching device
51, 151 First switching unit
52, 152 Second switching unit
101 Chamber
104*a*, 104*b* Inflow portion
105*a*, 105*b* Discharge portion
201 Communication tube
202 Internal passage
203 Communication hole
300 Fixed tube
301 Tube wall
305 Through hole

The invention claimed is:

1. A heat exchanger passage switching device, comprising:

a communication tube having an internal passage communicating with a heat exchange passage for performing heat exchange inside a heat exchanger, and one or more communication holes communicating with the internal passage; and at least one chamber having an insertion hole into which the communication tube is inserted to slidably support the communication tube inserted in the insertion hole, wherein the communication tube is capable of switching a communication state between the one or more communication holes and the at least one chamber by a relative position of the communication tube to the at least one chamber in an axial direction, wherein the at least one chamber has at least one fixed tube which is fixed to each chamber and inside which the insertion hole is formed, wherein the at least one fixed tube has a through hole formed corresponding to each chamber and penetrating a tube wall of the fixed tube to allow communication between the insertion hole and each chamber, wherein when the communication tube is moved to the relative position where any of the through hole overlaps the one or more communication holes, the communication tube allows communication between the internal passage and the chamber corresponding to the through hole that overlaps the one or more communication holes, and the communication tube blocks communication between the internal passage and the chamber corresponding to the through hole that does not overlap the one or more communication holes.

2. A heat exchanger passage switching device, comprising:

a communication tube having an internal passage communicating with a heat exchange passage for performing heat exchange inside a heat exchanger, and one or more communication holes communicating with the internal passage; and at least one chamber having an insertion hole into which the communication tube is inserted to slidably support the communication tube inserted in the insertion hole, wherein the communication tube is capable of switching a communication state between the one or more communication holes and the at least one chamber by a relative position of the communication tube to the at least one chamber in an axial direction, wherein the heat exchanger passage switching device comprises at least two communication tubes, wherein the at least one chamber includes at least two chambers stacked along the axial direction, wherein the at least two chambers have at least two insertion holes into which the at least two communication tubes are inserted, respectively, and wherein each of the at least two communication tubes is configured to select which one of the at least two chambers to be communicated with the communication hole by the relative position to the chamber.

3. A heat exchanger passage switching device, comprising:

a communication tube having an internal passage communicating with a heat exchange passage for performing heat exchange inside a heat exchanger, and one or more communication holes communicating with the internal passage; and at least one chamber having an insertion hole into which the communication tube is inserted to slidably support the communication tube inserted in the insertion hole, wherein the communication tube is capable of switching a communication state between the one or more communication holes and the at least one chamber by a relative position of the communication tube to the at least one chamber in an axial direction, wherein the heat exchanger passage switching device comprises at least four communication tubes, wherein the at least one chamber includes at least four chambers stacked along the axial direction, wherein the at least four chambers have at least four insertion holes into which the at least four communication tubes are inserted, respectively, and wherein each of the at least four communication tubes is configured to select which one of the at least four chambers to be communicated with the communication hole by the relative position to the chamber.

4. A heat exchanger passage switching device, comprising:

a communication tube having an internal passage communicating with a heat exchange passage for performing heat exchange inside a heat exchanger, and one or more communication holes communicating with the internal passage; and at least one chamber having an insertion hole into which the communication tube is inserted to slidably support the communication tube inserted in the insertion hole, wherein the communication tube is capable of switching a communication state between the one or more communication holes and the at least one chamber by a relative position of the communication tube to the at least one chamber in an axial direction, wherein the heat exchanger passage switching device comprises a first switching unit and a second switching unit each of which includes at least two communication tubes and at least two chambers stacked along the axial direction, wherein the first switching unit and the second switching unit are arranged at positions that do not overlap each other when viewed from the axial direction, and wherein, in each of the first switching unit and the second switching unit, the at least two chambers have at least two insertion holes into which the at least two communication tubes are inserted, respectively, and each of the at least two communication tubes is configured to select which one of the at least two chambers to be communicated with the communication hole by the relative position to the chamber.

5. A heat exchanger passage switching device, comprising:

a communication tube having an internal passage communicating with a heat exchange passage for performing heat exchange inside a heat exchanger, and one or more communication holes communicating with the internal passage; and at least one chamber having an insertion hole into which the communication tube is inserted to slidably support the communication tube inserted in the insertion hole, wherein the communication tube is capable of switching a communication state between the one or more communication holes and the at least one chamber by a relative position of the communication tube to the at least one chamber in an axial direction, wherein the heat exchanger passage switching device comprises at least eight communication tubes, wherein the at least one chamber includes at least six chambers stacked along the axial direction, wherein the at least six chambers have at least eight insertion holes into which the at least eight communication tubes are inserted, respectively, and wherein each of the at least eight communication tubes is configured to select which one of the at least six chambers to be communicated with the communication hole by the relative position to the chamber.

6. A heat exchanger passage switching device, comprising:

a communication tube having an internal passage communicating with a heat exchange passage for performing heat exchange inside a heat exchanger, and one or more communication holes communicating with the internal passage; and at least one chamber having an insertion hole into which the communication tube is inserted to slidably support the communication tube inserted in the insertion hole, wherein the communication tube is capable of switching a communication state between the one or more communication holes and the at least one chamber by a relative position of the communication tube to the at least one chamber in an axial direction, wherein the heat exchanger passage switching device comprises a first switching unit and a second switching unit each of which includes at least four communication tubes and at least three chambers stacked along the axial direction, wherein the first switching unit and the second switching unit are arranged at positions that do not overlap each other when viewed from the axial direction, and wherein, in each of the first switching unit and the second switching unit, the at least three chambers have at least four insertion holes into which the at least four communication tubes are inserted, respectively, and each of the at least four communication tubes is configured to select which one of the at least three chambers to be communicated with the communication hole by the relative position to the chamber.

7. The heat exchanger passage switching device according to claim 1, wherein at least two chambers have openings that allow a fluid to flow between inside and outside of the chambers regardless of the relative position of the communication tube.

8. The heat exchanger passage switching device according to claim 1, wherein a heat insulation layer is disposed between the chambers that are adjacent to each other along the axial direction.

9. The heat exchanger passage switching device according to claim 1, wherein a dimension of the at least one chamber in the axial direction is smaller than a dimension in a direction perpendicular to the axial direction.

* * * * *